US010441484B2

(12) United States Patent
Itano

(10) Patent No.: US 10,441,484 B2
(45) Date of Patent: Oct. 15, 2019

(54) WHEELCHAIR

(71) Applicant: SWANY CORPORATION, Kagawa (JP)

(72) Inventor: Tsukasa Itano, Higashikagawa (JP)

(73) Assignee: SWANY CORPORATION, Kagawa (JP)

( * ) Notice: Subject to any disclaimer, the term of this patent is extended or adjusted under 35 U.S.C. 154(b) by 64 days.

(21) Appl. No.: 15/666,797

(22) Filed: Aug. 2, 2017

(65) Prior Publication Data

US 2018/0042794 A1 Feb. 15, 2018

(30) Foreign Application Priority Data

Aug. 9, 2016 (JP) ..... 2016-156406

(51) Int. Cl.

| | |
|---|---|
| ***A61G 5/02*** | (2006.01) |
| ***A61G 5/08*** | (2006.01) |
| *A61G 5/12* | (2006.01) |
| *A61G 5/10* | (2006.01) |

(52) U.S. Cl.

CPC ..... *A61G 5/028* (2013.01); *A61G 5/0825* (2016.11); *A61G 5/1037* (2013.01); *A61G 5/128* (2016.11)

(58) Field of Classification Search

CPC ..... A61G 5/028; A61G 5/0825; A61G 5/128; A61G 5/1037

See application file for complete search history.

(56) References Cited

U.S. PATENT DOCUMENTS

| | | | | |
|---|---|---|---|---|
| 4,366,964 | A * | 1/1983 | Farey | A61G 5/02 280/250.1 |
| 4,687,218 | A * | 8/1987 | Okamoto | A61G 5/02 280/250.1 |
| 6,120,047 | A * | 9/2000 | Axelson | A61G 5/02 280/250.1 |
| 6,241,268 | B1 * | 6/2001 | Niklasson | A61G 5/02 280/250.1 |
| 6,439,281 | B1 * | 8/2002 | Hogg | A61G 5/028 152/152 |
| 7,303,203 | B1 * | 12/2007 | Richter | A61G 5/02 280/250.1 |
| 8,998,245 | B1 | 4/2015 | Anooshian et al. | |

(Continued)

FOREIGN PATENT DOCUMENTS

| | | |
|---|---|---|
| JP | 11-347072 | 12/1999 |
| JP | 2013-066637 | 4/2013 |
| SE | 518 496 | 10/2002 |

*Primary Examiner* — Joseph M Rocca
*Assistant Examiner* — Marlon A Arce
(74) *Attorney, Agent, or Firm* — Wenderoth, Lind & Ponack, L.L.P.

(57) ABSTRACT

A wheelchair is provided which includes a body, and driving wheels arranged on the both sides of the body. The wheels include a rim portion, a hub portion, an hand rim, and fastening members. A tire is attached to the outer peripheral part of the rim portion. The hub portion is arranged at the center of the rim portion and coupled to the rim portion by connecting members. The hand rim is arranged along the rim portion on the exterior side of the rim portion. The fastening members fasten the hand rim to the rim portion. An insertion prohibition spacing is formed between the rim portion and the hand rim. The spacing has a distance capable of prohibiting insertion of user's thumb into this spacing.

10 Claims, 14 Drawing Sheets

(56) References Cited

U.S. PATENT DOCUMENTS

| | | | | |
|---|---|---|---|---|
| 9,839,566 | B2 * | 12/2017 | Yentzer | A61G 5/02 |
| 2013/0320749 | A1 * | 12/2013 | Connolly | B60B 1/042 301/58 |
| 2014/0077581 | A1 * | 3/2014 | Kanno | B60K 17/043 301/6.5 |
| 2016/0242976 | A1 * | 8/2016 | Daigle | A61G 5/022 |
| 2017/0014286 | A1 * | 1/2017 | Richter | A61G 5/028 |
| 2018/0042795 | A1 * | 2/2018 | Itano | A61G 5/0825 |

* cited by examiner

WHEELCHAIR

CROSS-REFERENCE TO RELATED APPLICATIONS

The present application claims priority under 35 U. S. C. § 119 to Japanese Patent Application No. 2016-156,406, filed on Aug. 9, 2016. The contents of this application are incorporated herein by reference in their entirety.

BACKGROUND OF THE INVENTION

1. Field of the Invention

The present invention relates to a wheelchair which include a wheelchair body that has a seat, and driving wheels that are arranged on the both sides of the wheelchair body and can be rotated by hand to propel the wheelchair.

2. Description of the Related Art

Manually propelled wheelchairs are widely used. The typical type of manually-propelled wheelchair includes hand rims on driving wheels, which are arranged on the both sides of the wheelchair, in order to allow the wheelchair user to maneuver the wheelchair by himself. As shown in FIG. 14, the driving wheel of the wheelchair includes a hub (not shown) and a rim 92, which is coupled to the hub by spokes (not shown) and holds a tire 91 on the outer periphery of the rim 92. An annular hand rim 95 is fastened to the exterior side of the rim 92, and has an outer diameter smaller than the tire 91. The hand rim 95 is spaced away from the rim 92 so that the user can easily grasp the hand rim 92 when rotating the driving wheel 90. Coupling arms 93 are spaced at a predetermined circumferential interval to the hand rim 95 and fastened to provide the space between the hand rim 95 and the rim 92. In other words, the hand rim 95 is fastened by the coupling arms 93 to the rim 92. The user can move or propel this wheelchair by pushing on the hand rims 95 by hand whereby rotating the driving wheels 90.

When the user rotates the driving wheels of this wheelchair, user's thumb or finger may contact the coupling arm, and such contact may cause pain. For this reason, there is a disadvantage that the user cannot comfortably use this wheelchair. For example, as shown in FIG. 14, in the case where the user grasps the hand rim 95 from the top side, user's thumb S is likely to be deeply inserted into the spacing between the hand rim 95 and the rim 92, on the other hand, in the case where the user strongly grasps the hand rim 95, user's fingers F (other than his/her thumb) will move beyond the top of the hand rim 95 along the interior-side surface of the hand rim 95. In particular, in the case where the user strongly grasps the hand rim 95 so that user's fingers are deeply inserted into the spacing between the hand rim 95 and the rim 92, the coupling arm 93 may hit the inserted finger F in the rotation of the driving wheel. This may damage the hit finger. In case where the finger becomes entangled with the coupling arm 93, this may cause a hard injury (e.g., broken bone) at the worst. For this reason, in typical wheelchairs, when rotating the driving wheel, users are required to take their hands off the hand rims whereby preventing their thumbs and fingers from hitting the coupling arms. That is, there is a problem that users cannot slide his/her hand on the hand rims in the rotation of the driving wheels.

To solve the problems, a wheelchair has been developed which includes disks fastened to the exterior sides of the wheels (Japanese Patent Laid-Open Publication No. JP H11-347072 A (1999)). In the wheelchair disclosed in JP H11-347072 A, as shown in a cross-sectional view of FIG. 15, a disk 81 is fastened to the exterior side of a wheel 80, and a protruding portion 85 is arranged on the outer exterior-side part of the disk 81. The wheelchair user can grasp the protruding portion 85.

In the case of the wheel 80 of the wheelchair shown in FIG. 15, the user grasps the protruding portion 85 of the disk 81, which is fastened to the exterior side of the wheel 80, when rotating the wheel 80 by hand. This wheel 80 has a disadvantage that user's hand is likely to slip when the user rotating the wheel 80 since the user holds the protruding portion 85 of the disk 81 by pressing the outer and inner peripheral surfaces of the protruding portion 85 with user's palm and fingers. On the other hand, if user strongly presses the outer and inner peripheral surfaces of the protruding portion 85, the user will have muscle fatigue on user's hand. Also, since the disk 81 is fastened to the rim 82, and the protruding portion 85 protrudes outward from the disk 81, the entire width of the wheel 80 is large. As a result, the wheel 80 has a disadvantage that the wheelchair cannot smoothly move in narrow rooms, and the like. Similar to this, since the hand rim 95 of the typical driving wheel 90 protrudes outward from the wheel 90 as shown in FIG. 14, the width of the driving wheel 90 is large. As a result, this wheel also has a disadvantage that the wheelchair cannot smoothly move in narrow rooms, and the like.

The present invention has been developed for solving the disadvantages. It is one object of the present invention to provide a wheelchair that includes simple driving wheels easily manufactured but can prevent injuries to users' hands in rotation of the driving wheels and can be comfortably used.

It is another object of the present invention to provide a wheelchair that includes driving wheels with a reduced width, and can be smoothly moved even in narrow rooms.

SUMMARY OF THE INVENTION

A wheelchair according to the present invention includes a wheelchair body 10, and driving wheels 3. The wheelchair body 10 includes a seat 5. The driving wheels 3 are arranged on the both sides of the wheelchair body 10, and can be rotated by hand to propel the wheelchair. Each of the driving wheels 3 includes a rim portion 32, a hub portion 33, an annular hand rim 35, and fastening members 50. The rim portion 32 holds a tire 31 on the outer peripheral part of the rim portion 32. The hub portion 33 is arranged at the center of the rim portion 32 and coupled to the rim portion 32 by connecting members 34, and can rotate with respect to the wheelchair body 10. The annular hand rim 35 is arranged along the rim portion 32 on the exterior side of the rim portion 32. The fastening members 50 fasten the hand rim 35 to the rim portion 32. The driving wheels 3 can be rotated by pushing forces applied to the hand rims 35 by hand. In this wheelchair, the hand rim 35 is arranged in proximity to the rim portion 32 so that an insertion prohibition spacing 36 is formed between the rim portion 32 and the hand rim 35. The insertion prohibition spacing 36 has a distance capable of prohibiting insertion of user's thumb S into this insertion prohibition spacing 36.

According to the wheelchair of the present invention, since the hand rim is arranged in proximity to the rim portion, which is fastened to the driving wheel, so that an insertion prohibition spacing that has a distance capable of prohibiting insertion of user's thumb into this insertion prohibition spacing is formed between the rim portion and the hand rim, this wheelchair can surely prevent insertion of user's thumb into the spacing between the rim portion and the hand rim when the user pushes on the hand rims by hand whereby rotating the driving wheels. That is, this can prevent damage to user's fingers. Consequently, users can comfortably use this wheelchair. In particular, according to this driving wheel, the hand rim is not in contact with the rim portion, and is spaced at a predetermined distance away from the rim portion. As a result, it is possible to efficiently prevent sacrifice of ease of gripping and handling. Therefore, users can safely use the wheelchair by grasping the hand rims without concern.

In addition, according to this wheelchair, since the hand rim coupled to the exterior side of the driving wheel is arranged close to the rim portion, the protruding amount of the hand rim toward the exterior side of the driving wheel can be small. As a result, the width of the wheelchair can be reduced. Consequently, the wheelchair can smoothly move even in narrow rooms. Also, since the coupling distance between the rim portion and the hand rim can be small, it is possible to reduce loads applied to the fastening members, which interlinks the hand rim with the rim portion, but pushing forces applied to the hand rim can be surely transmitted to the driving wheels. Therefore, the wheelchair can improve ease of handling.

In addition, according to this wheelchair, users can easily propel the wheelchair by applying small pushing forces to the driving wheels. The reason is that the hand rims, which are fastened to the driving wheels, can be positioned closer the rim portions, in other words, the hand rims can be arranged closer to the natural positions of hands of the user who sits on the seat. Generally speaking, in the case where a person applies a force to a member near his/her body, he/she can more easily transmit the force to the member as the member is located closer to his/her body, while it becomes more difficult to transmit the force to the member as the member is located further away from his/her body. In the case of manually-propelled wheelchairs, the user who sits on the seat of their wheelchair body grasps the hand rims of the driving wheels, which are arranged on the both sides of the wheelchair body, when propelling the wheelchair. In the wheelchair according to the present invention, since the hand rim is arranged in proximity to the rim portion, the positions of the hand rims to which the user applies forces can be closer to his/her body when pushing on the hand rims. For this reason, the user can easily transmit forces to the hand rims of this wheelchair. As a result, pushing forces required to propel the wheelchair can be small. Consequently, the user can easily propel the wheelchair by applying small pushing forces to the driving wheels. In particular, it is very important for disabled persons and aged persons to reduce pushing forces required to propel wheelchairs as much as possible. From this viewpoint, the structure of the wheelchair according to the present invention is effective which allows the user to safely and easily push on the hand rims.

In the wheelchair according to the present invention, the gap (k) in the width direction between the hand rim 35 and the rim portion 32 can be smaller than the thickness of user's finger F.

According to this construction, even if the user will unwittingly grasp the upper part of the hand rim so that user's fingers (other than his/her thumb) are being inserted from the bottom side into the gap on the interior side of the hand rim, this construction can effectively prevent creation of the path which directly guides the fore ends of the fingers to the insertion prohibition spacing. In particular, since the gap in the width direction between the hand rim and the rim portion is dimensioned small, the fore ends of user's fingers under the insertion motion from the bottom side of the hand rim are likely to contact the inner peripheral surface of the rim portion. Accordingly, the rim portion can reduce the momentum of user's fingers under the insertion motion from the bottom side. As a result, it is possible to effectively prevent the fore ends of the fingers from directly moving into the insertion prohibition spacing. That is, even if the user will unwittingly grasp the hand rim, this construction can prevent user's fingers (other than his/her thumb) from entering the insertion prohibition spacing. For this reason, even in the case where the distance of the insertion prohibition spacing is dimensioned larger than the thickness of the fingers, it is possible to effectively prevent user's fingers from passing through the insertion prohibition spacing when his/her fingers are being inserted from the bottom side of the hand rim.

In the wheelchair according to the present invention, the distance (d) of the insertion prohibition spacing 36 can be dimensioned to be able to prohibit insertion of user's finger F into this insertion prohibition spacing.

According to this construction, even if the user will unwittingly grasp the hand rim so that user's fingers (other than his/her thumb) are being inserted from the bottom side into the gap on the interior side of the hand rim, this construction can surely prevent insertion of his/her fingers into the insertion prohibition spacing. As a result, the user will not strongly grasp the hand rim. Therefore, it is possible to surely prevent damage to user's fingers by the fastening members in rotation of the driving wheels. Consequently, this wheelchair has improved safety.

In the wheelchair according to the present invention, the distance (d) of the insertion prohibition spacing 36 can fall within the range of not greater than 15 mm. This construction can safely protect fingers of most users when they use this wheelchair.

In the wheelchair according to the present invention, the average diameter (Da) of the hand rim 35 can be smaller than the inner diameter (R) of the rim portion 32.

In this specification, the average diameter (Da) of the hand rim 35 refers to the average of the outer diameter (Do) and the inner diameter (Di) of the hand rim 35. That is, the average diameter (Da) is defined by the formula of Average Diameter (Da)=[Outer Diameter (Do)+Inner Diameter (Di)]/2.

In this construction, since the average diameter of the hand rim is smaller than the inner diameter of the rim portion, the hand rim can be arranged further inward of the wheelchair although the insertion prohibition spacing is formed between the rim portion and the hand rim. Therefore, the width of the wheelchair can be ideally reduced. Also, since the average diameter of the hand rim is small, in other words, the hand rim is arranged on the center side of the driving wheel relative to the rim portion, the hand rim can be spaced away from the tire. As a result, this construction can effectively prevent user's hands from directly touching the tires when pushing on the hand rims.

In the wheelchair according to the present invention, the fastening member 50 can substantially extend in the horizontal direction. In addition, a first end of the fastening member 50 can be fastened to the interior-side surface of the hand rim 35, and a second end of the fastening member 50 can be fastened to the inner peripheral surface of the rim portion 32.

In this specification, the interior side of the driving wheel or the hand rim refers to the seat side in the width direction of the wheelchair, and the exterior side of the driving wheel or the hand rim refers to the opposite side to the seat side in the width direction of the wheelchair.

According to this construction, since a first end of the fastening member, which substantially extends in the horizontal direction, is fastened to the interior-side surface of the hand rim, and a second end of the fastening member is fastened to the inner peripheral surface of the rim portion, the length of the fastening member can be minimized which interlinks the hand rim with the rim portion. For this reason, loads applied to the fastening members can be reduced, while the hand rim can be ideally arranged in proximity to the rim portion so that the insertion prohibition spacing can be formed between the hand rim and the rim portion. Also, the hand rim can be correctly arranged at the position relative to the rim portion by a plurality of fastening members which extend in the horizontal direction. Therefore, the insertion prohibition spacing can have a uniform width along the outer periphery of the hand rim.

In the wheelchair according to the present invention, the position of the hand rim 35 is adjustable in the width direction of the wheelchair by the fastening members 50.

According to this construction, since the position of the hand rim to the rim portion can be adjusted in the width direction of the wheelchair, the width of the insertion prohibition spacing between the rim portion and the hand rim can be varied. As a result, the distance of the insertion prohibition spacing can be optimized in accordance with users. Therefore, users can safely and conveniently use this wheelchair.

In the wheelchair according to the present invention, each of the fastening members 50 can include a fastening piece 51, a fastening screw 52, a cylindrical spacer 53, and a nut 54. The fastening piece 51 protrudes from the inner peripheral surface toward the center of the rim portion 32. The fastening screw 52 passes through the fastening piece 51, and protrudes toward the exterior side of the driving wheel 3. The cylindrical spacer 53 is arranged between the fastening piece 51 and the hand rim 35. The shank part 52*a* of the fastening screw 52 is inserted into the cylindrical spacer 53. The nut 54 is fastened to the interior side of the hand rim 35, and threadedly engages the fastening screw 52. The position of the hand rim 35 can be adjusted by adjusting a length of the cylindrical spacer 53.

According to this construction, the hand rim can be simply and easily coupled to the rim portion by passing the fastening screw through the fastening piece, which protrudes from the inner peripheral surface toward the center of the rim portion, and screwing the fastening screw into the nut, which is fastened to the interior-side surface of the hand rim. In particular, since the screwing direction of the fastening screw extends in the coupling direction of the hand rim to the rim portion, the hand rim can be firmly coupled by tightening the fastening screw into the hand rim. Also, the position of the hand rim can be easily adjusted by adjusting a length of the cylindrical spacer, which is arranged between the hand rim and the fastening piece and receives the shank part or thread part of the fastening screw inserted to the cylindrical spacer. Also, according to this wheelchair, the hand rim can be easily detached from the driving wheel by removing the fastening members. This wheelchair can be subjected to maintenance after the hand rim is detached. In this wheelchair, the hand rims can be easily replaced. This wheelchair may be moved without hand rims.

In the wheelchair according to the present invention, each of the fastening members 50 can include a fastening arm 57, and a fastener 56. A first end of the fastening arm 57 is fastened to the hand rim 35 and a second end of the fastening arm 57 is fastened to the inner peripheral surface of the rim portion 32. The fastener 56 fastens the second end of the fastening arm 57 to the inner peripheral surface of the rim portion 32. The fastening arm 57 has a plurality of through holes 57*a* in the second end. The fastening arm 57 is fastened to the rim portion 32 by the fastener 56 which passes through one of the through holes 57*a*. The one of the through holes 57*a* which receives the fastener 56 is selected to adjust the position of the hand rim 35.

The hand rim can be arranged in the predetermined position relative to the driving wheel by this simple construction. In addition to this, the position of the hand rim can be adjusted by selecting one of the through holes of the fastening arm which receives the fastener. Also, according to this wheelchair, the hand rim can be easily detached from the driving wheel by removing the fastening members. This wheelchair can be subjected to maintenance after the hand rim is detached. In this wheelchair, the hand rims can be easily replaced. This wheelchair may be moved without hand rims.

In the wheelchair according to the present invention, the wheelchair body 10 can include a pair of side frames 1, a folding linkage 2, and a flexible seat 7. The pair of side frames 1 rotatably support the driving wheels 3, which are coupled to the exterior sides of the side frames 1. The folding linkage 2 includes seat frames 6. The bottom ends of the folding linkage 2 are coupled to the pair of side frames 1. The top ends of the folding linkage 2 are coupled to the seat frames 6. The flexible seat 7 is coupled to the right and left seat frames 6 of the folding linkage 2. The wheelchair body 10 can be folded by moving the side frames 1 toward each other in their vertical orientation. The flexible seat 7, which is coupled to the right and left seat frames 6, can be held under tension whereby forming the seat 5 by moving the side frames 1 away from each other when the wheelchair body 10 is unfolded.

According to this construction, the wheelchair can be compact and conveniently carried when the wheelchair body is folded in the width direction. According to the wheelchair of the present invention, since the position of the hand rim, which is fastened to the driving wheel, can be close to the rim portion, the width of the driving wheel can be reduced. For this reason, in particular, in this construction, the width of the entire wheelchair can be further reduced when the wheelchair body is folded in the width direction. Therefore, the wheelchair can be more compactly folded in the width direction.

In the wheelchair according to the present invention, the connecting members 34 can be spokes 34X. The spokes 34X are spaced at a constant interval away from each other in the circumferential direction, and interlink the hub portion 33 with the inner peripheral surface of the rim portion 32. The fastening member 50 can be arranged at the midpoint between the spokes 34X adjacent to each other on the inner peripheral surface of the rim portion 32.

According to this construction, since the fastening member are arranged at the midpoint between the spokes adjacent to each other on the inner peripheral surface of the rim portion, and interlinks the hand rim with the rim portion, the spokes do not obstruct the work for coupling the hand rim to the rim portion. As a result, the hand rim can be easily coupled to the rim portion in the coupling work. Also, since the fastening member for fastening the hand rim is arranged at the midpoint between the spokes adjacent to each other, the pushing forces applied to the hand rims can be evenly transmitted to the adjacent spokes and to the driving wheels.

In the wheelchair according to the present invention, the hub portion 33 can include a pair of flanges 37 that are arranged on the interior and exterior sides of the driving wheel 3. The spokes 34 can be coupled to the flanges 37. A first set of spokes 34C and a second set of spokes 34D can be included as the spokes 34. The first set of spokes 34C are coupled to the first flange 37A, which is arranged on the interior sides of the driving wheel 3. The second set of spokes 34D are coupled to the second flange 37B, which is arranged on the exterior side of the driving wheel 3. The first set of spokes 34C and the second set of spokes 34D are alternately arranged. The first set of spokes 34C can be shorter than the second set of spokes 34D. The rim portion 32 can be offset inward relative to the center plane of the hub portion 33.

According to this construction, since the rim portion is offset inward relative to the center plane of the hub portion, the hand rim, which is arranged on the exterior side of the driving wheel, can be arranged on the interior side as compared with the case where the rim portion is not offset inward. As a result, the width of the entire wheelchair can be further reduced. In particular, in the case where the wheelchair is foldable in the width direction, according to this construction, the width of the folded wheelchair can be further reduced. Therefore, this wheelchair can be conveniently carried.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
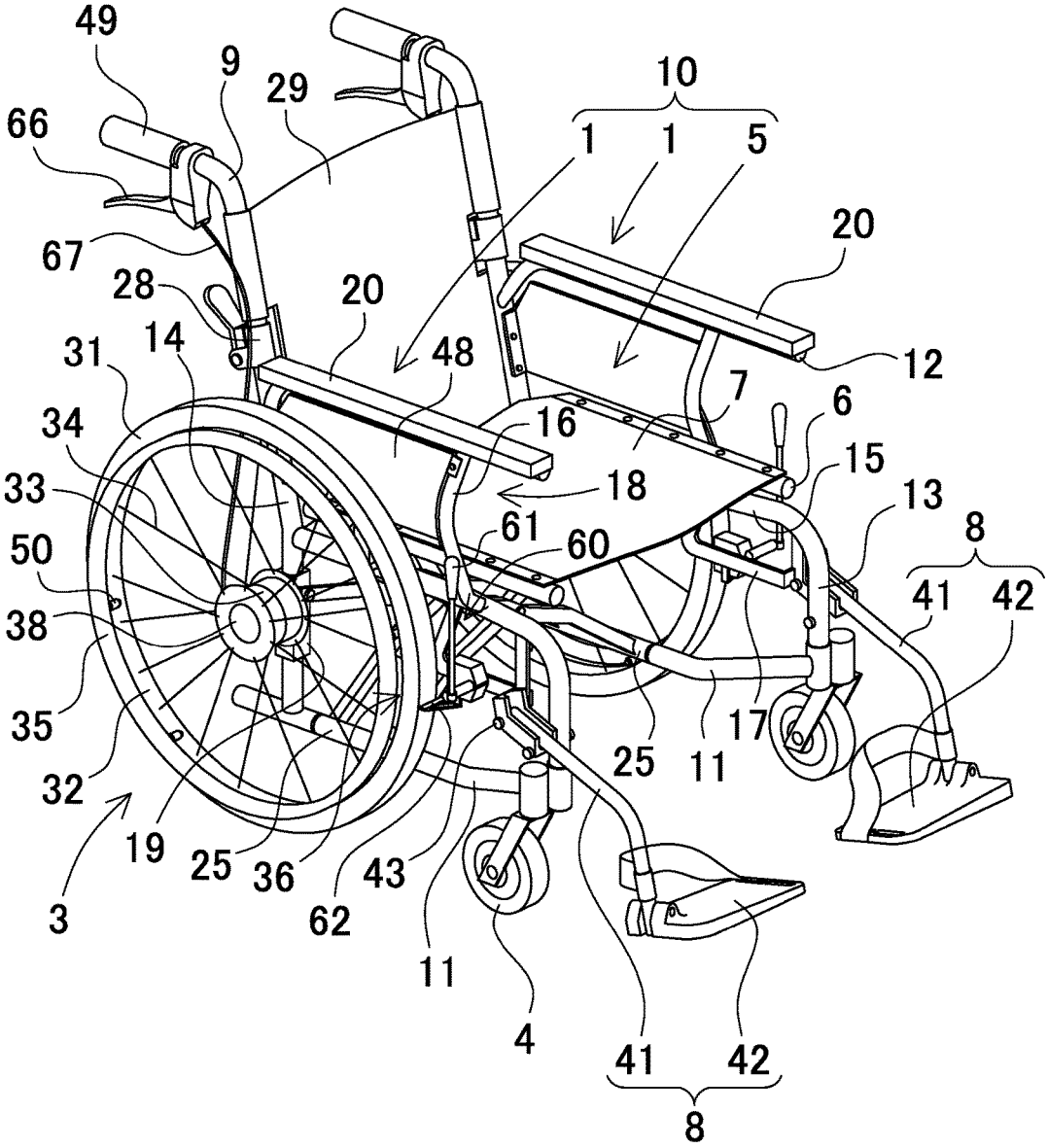
FIG. 1 is a perspective view of a wheelchair according to an embodiment of the present invention.

The embodiments will now be described with reference to the accompanying drawings, wherein like reference numerals designate corresponding or identical elements throughout the various drawings.

It should be appreciated, however, that the embodiments described below are illustrations of a wheelchair to give a concrete form to technical ideas of the invention, and a wheelchair of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown exaggeratingly for ease of explanation. Members same as or similar to those of this invention are attached with the same designation and the same reference numerals and their description is omitted. In addition, a plurality of structural elements of the present invention may be configured as a single part that serves the purpose of a plurality of elements, on the other hand, a single structural element may be configured as a plurality of parts that serve the purpose of a single element.

Figure 2:
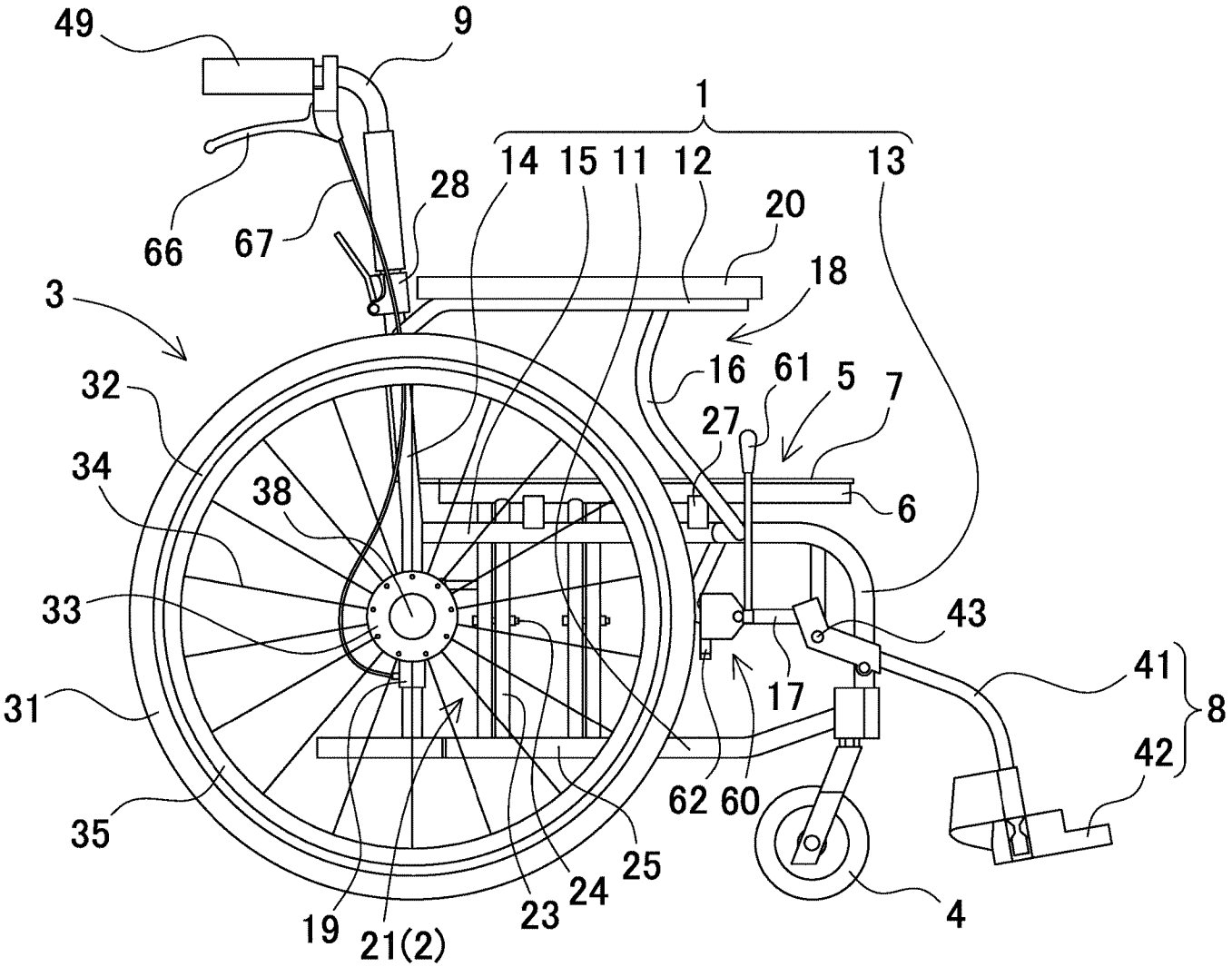
FIG. 2 is a side view of the wheelchair shown in FIG. 1.
Figure 3:
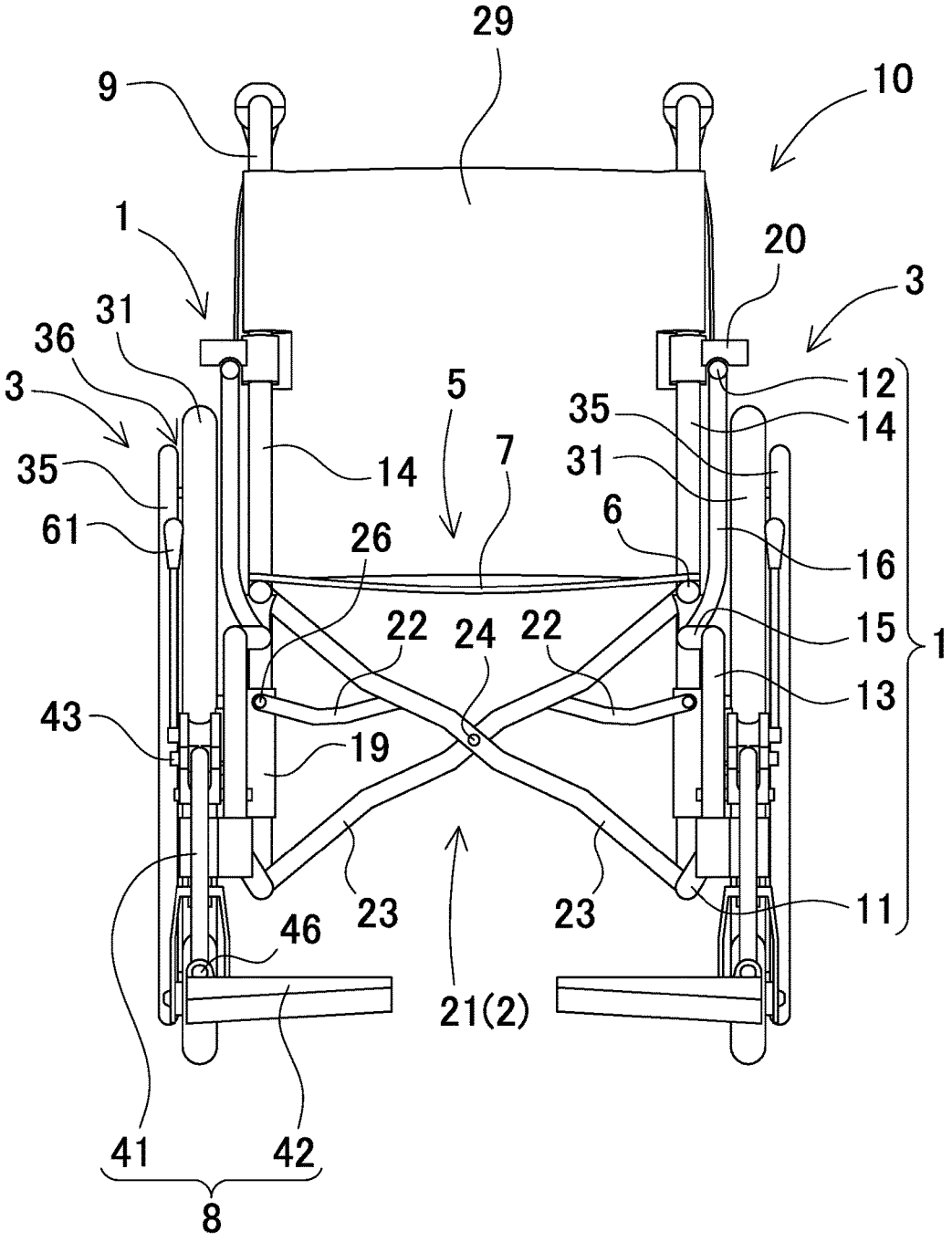
FIG. 3 is a front view of the wheelchair shown in FIG. 1.
Figure 4:
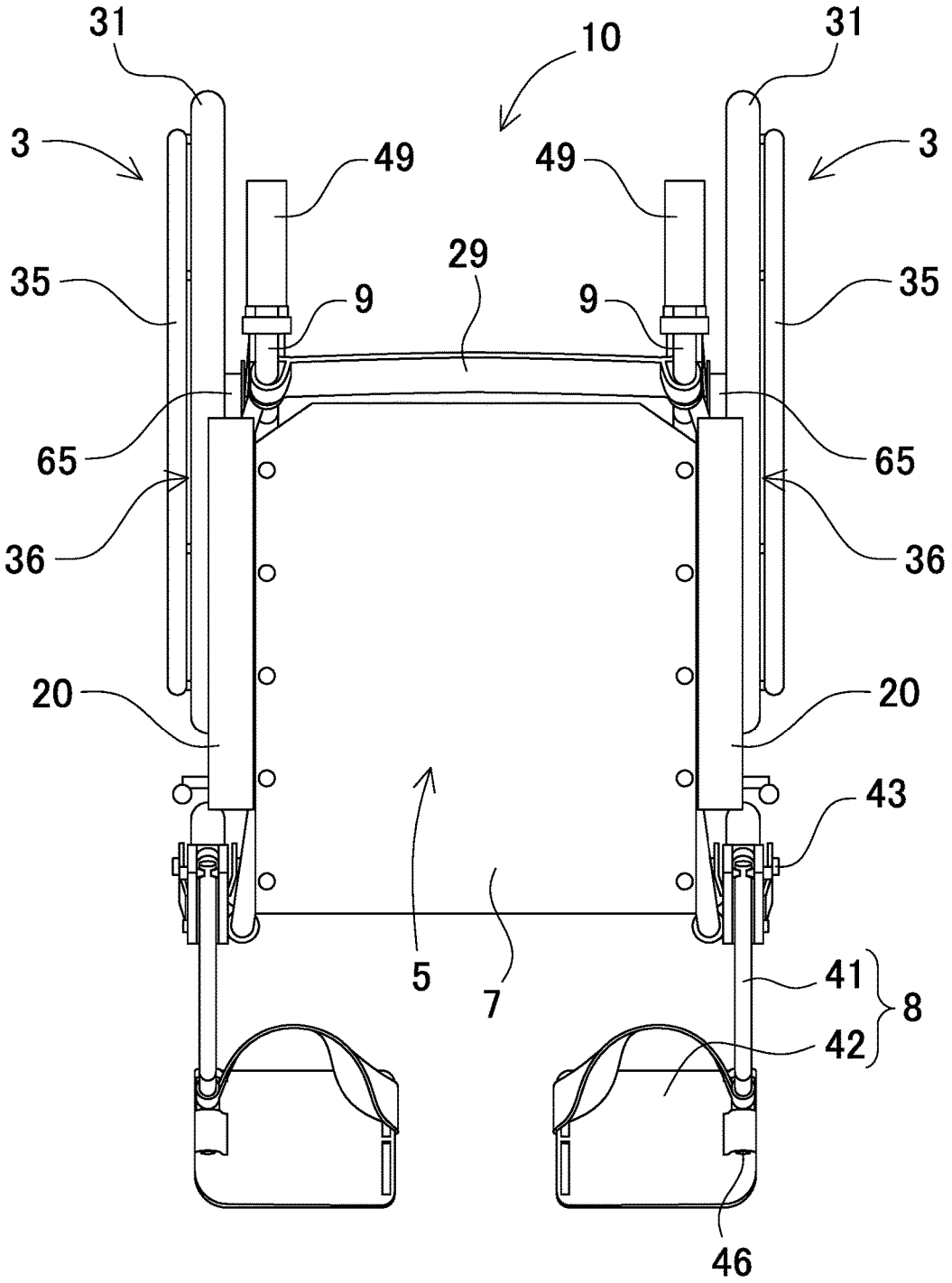
FIG. 4 is a plan view of the wheelchair shown in FIG. 1.
Figure 5:
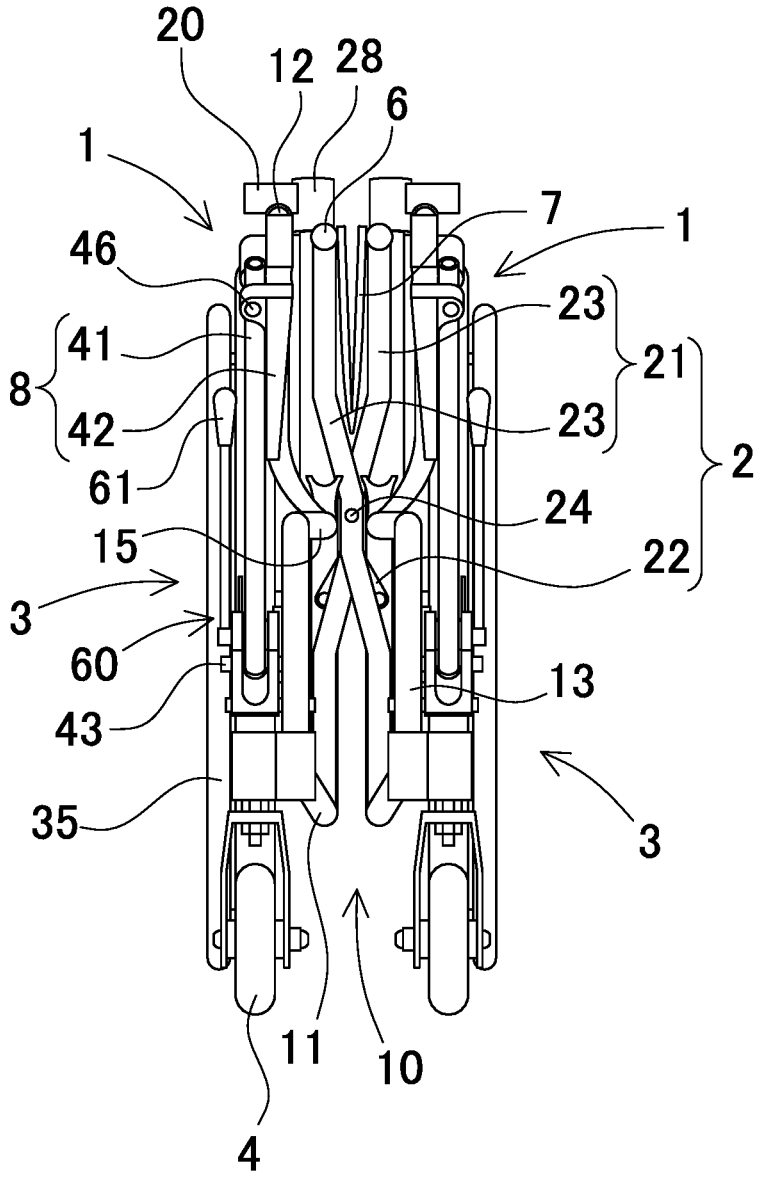
FIG. 5 is a front view showing the wheelchair shown in FIG. 3 when folded.

A wheelchair according to an embodiment of the present invention is shown in FIGS. 1 to 5. FIG. 1 shows a perspective view of the wheelchair. FIGS. 2, 3 and. 4 show side, front, and plan views of the wheelchair shown in FIG. 1, respectively. FIG. 5 shows a front view showing the folded wheelchair shown in FIG. 3. The wheelchair shown in FIGS. 1 to 4 has a foldable structure which makes a wheelchair body 10 foldable in the width direction as shown in FIG. 5. Driving wheels 3 are arranged on the both sides of the wheelchair body 10. The wheelchair body 10 can be folded by moving the driving wheels 3 toward each other. As a result, the wheelchair can be conveniently carried. Following description will describe the wheelchair according to the embodiment of the present invention which includes the wheelchair body foldable in the width direction. However, the present invention is not limited to such a foldable wheelchair, and can be applied to an unfoldable wheelchair.

As shown in FIGS. 1 to 5, the driving wheels 3 are arranged on the both sides of the wheelchair body 10. The wheelchair body 10 of the wheelchair includes a seat 5. The driving wheels 3 are located on the both sides of the wheelchair user when sitting on the seat 5, and can be rotated by hands to propel the wheelchair. Each of the driving wheels 3 includes a rim portion 32, a hub portion 33, an annular hand rim 35, and fastening members 50. The rim portion 32 holds a tire 31 on the outer peripheral part of the rim portion 32. The hub portion 33 is arranged at the center of the rim portion 32 and coupled to the rim portion 32 by connecting members 34, and can rotate with respect to the wheelchair body 10. The annular hand rim 35 is arranged along the rim portion 32 on the exterior side of the rim portion 32. The fastening members 50 fasten the hand rim 35 to the rim portion 32. The driving wheel 3 can be rotated by pushing forces applied to the hand rim 35 by hand. In this wheel 3, the hand rim 35 is arranged in proximity to the rim portion 32 so that an insertion prohibition spacing 36 is formed between the rim portion 32 and the hand rim 35. The insertion prohibition spacing 36 has a distance capable of prohibiting insertion of user's thumb into this insertion prohibition spacing 36.

(Wheelchair Body 10)

The wheelchair body 10 includes a pair of side frames 1, a folding linkage 2, seat frames 6, and a flexible seat 7. The driving wheels 3 are coupled to the exterior sides of the side frames 1. The pair of side frames 1 are coupled to the bottom ends of the folding linkage 2. The folding linkage 2 includes seat frames 6. The seat frames 6 are coupled to the top ends of the folding linkage 2. The flexible seat 7 is coupled to the seat frames 6 of the folding linkage 2. The illustrated wheelchair further includes casters 4, and footrests 8. The casters 4 are coupled to the front parts of the side frames 1, and are free to swivel in the horizontal direction. The footrests 8 are coupled to the side frames 1.

The side frames 1 of the wheelchair body 10 are foldably coupled to each other by the folding linkage 2. The width of the wheelchair body 10 can be reduced by folding the folding linkage 2 by moving the both side frames 1 toward each other as shown in FIG. 5. The seat 5 of the wheelchair body 10 is constructed of the folding linkage 2 and the flexible seat 7, and arranged between the right and left side frames 1. The flexible seat 7 of the seat 5 is coupled to the seat frames 6 which are coupled to the upper ends of X-link portions 21 of the folding linkage 2. The flexible seat 7 is folded when the right and left side frames 1 are moved toward each other and the wheelchair is brought in a loose state as shown in FIG. 5. The flexible seat 7 can be held under tension and serves as the seat 5 when the right and left side frames 1 are moved away from each other and the wheelchair is brought in a tensioned state as shown in FIG. 3.

(Side Frames 1)

Each of the side frames 1 includes an elbow rest frame portion 12, a vertical frame portion 14, a bottom frame portion 11, a middle frame portion 15, a front frame portion 13, and an interlinking frame portion 16. The elbow rest frame portion 12 extends in the horizontal direction. An elbow rest 20 is arranged on the upper surface of the elbow rest frame portion 12. The vertical frame portion 14 is coupled to the rear end part of the elbow rest frame portion 12. The bottom frame portion 11 extends in the horizontal direction, and is coupled to the lower end part of the vertical frame portion 14. The middle frame portion 15 extends in the horizontal direction between the elbow rest frame portion 12 and the bottom frame portion 11. The front frame portion 13 interlinks the front end part of this middle frame portion 15 with the bottom frame portion 11. The interlinking frame portion 16 interlinks the front end part of the middle frame portion 15 with the front end part of the elbow rest frame portion 12. These frame portions of the side frame 1 are formed from metal pipes. The metal pipes are coupled to each other by welding, or the like. The side frame 1 further includes an axel portion 19 which is arranged in the lower part of the vertical frame portion 14. The driving wheel 3 is installed on the axel portion 19. The axel portion 19 includes an axle (not shown) which protrudes outward from the side frame. The driving wheel 3 is rotatably coupled to the axel.

(Elbow Rest Frame Portion 12)

The elbow rest frame portions 12 are arranged on the both sides above the seat 5 and substantially directly above the middle frame portions 15. Each of the elbow rest frame portions 12 extends in the horizontal direction. The elbow rests 20 are arranged on the upper surfaces of the elbow rest frame portions 12. The user can place his/her elbows on the elbow rests 20 when sitting on the seat 5.

(Bottom Frame Portion 11)

The bottom frame portions 11 are arranged on the both sides under the seat 5. The lower end of the vertical frame 14 is coupled to the rear end part of the bottom frame portion 11. The lower end of the front frame portion 13 is coupled to the front end of the bottom frame portion 11. The bottom frame portions 11 shown in FIG. 2 horizontally extend in the fore-and-aft direction. The front end part of the bottom frame portion 11 is inclined upward relative to the horizontal direction, and the front end of the bottom frame portion 11 is coupled to the front frame 13. This inclination provides the space for accommodating the caster 4 under the front end part of the bottom frame portion 11. This arrangement allows the casters 4 to be free to swivel without limiting the movement of the casters 4 when the casters 4 are mounted to the front frame portion 13.

(Middle Frame Portion 15)

The rear end of the middle frame portion 15 is coupled to the central part of the vertical frame portion 14. The front end of the middle frame portion 15 is coupled to the front frame portion 13, which extends downward. The front frame portion 13 is coupled to the bottom frame portion 11. The middle frame portion 15 and the front frame portion 13 shown in FIG. 2 are formed by bending the front part of one metal pipe downward. The illustrated front frame portion 13 extends in the horizontal direction. The bottom end of the front frame portion 13 is coupled the fore end of the bottom frame portion 11. The seat frames 6 are positioned above and parallel to the middle frame portions 15. The middle frame portions 15 include support portions 27 that support the seat frames 6 above the middle frame portions 15. The middle frame portions 15 are positioned at the height corresponding to the seat frames 6 when the folding linkage 2 is unfolded so that the flexible seat 7 is unfolded.

(Interlinking Frame Portion 16)

The upper end of the interlinking frame portion 16 is coupled to the point of the elbow rest frame portion 12 which is spaced at a distance away from the fore end of the elbow rest frame portion 12. The lower end of the interlinking frame portion 16 is coupled to the point of the middle frame portion 15 which is spaced at a distance away from the front part of the middle frame portion 15. As shown in FIG. 2, the side frame 1 has an accommodation space portion 18 which is provided in front of the interlinking frame portion 16 between the elbow rest frame portion 12 and the middle frame portion 15, and can accommodate the footrest 8 when the footrest 8 is folded and accommodated into the side frame 1. The interlinking frame portion 16 has a curved form which bulges rearward in its central part. Accordingly, the accommodation space portion 18 can be large.

(Front Frame Portion 13)

The front frame portions 13 are arranged on the both sides of the front end of the seat 5, and extend in the horizontal direction. The front ends of the middle frame portions 15 are coupled to the front ends of the bottom frame portions 11 through the front frame portions 13. The illustrated front frame portions 13 are coupled to the footrests 8, which are located in front of the seat 5. More specifically, the illustrated wheelchair includes a pair of footrests 8, which are located in front of the seat 5 on the exterior sides of the side frames 1. The footrests 8 are coupled to the right and left front frame portions 13.

(Vertical Frame Portion 14)

The vertical frame portions 14 are arranged on the both sides of the rear end of the seat 5, and substantially vertically extend. The rear ends of the elbow rest frame portions 12 and the middle frame portions 15 are coupled to the central parts of the vertical frame portions 14 shown in FIGS. 1 and 2. The rear end parts of the bottom frame portions 11 are coupled to the bottom ends of the vertical frame portions 14. The vertical frame portions 14 include the axel portions 19, which are arranged in the lower parts of the vertical frame portions 14.

(Axle Portion 19)

The axle portions 19 have a prismatic exterior shape (more specifically, rectangular prism) which vertically extends as shown in FIG. 1. The exterior-side surfaces of the rectangular prism shaped axle portions 19 are oriented parallel to the side frames 1. The axles are inserted from the both right and left sides of the axle portions 19, and pass through the axle portions 19. The axles protrude perpendicular to the exterior-side surfaces of the axle portions 19, and are fixed to the axle portions 19.

(Handle Portion 9)

The wheelchair shown in FIGS. 1 and 2 includes foldable handle portions 9 which are coupled to the top ends of the vertical frame portions 14. The handle portion 9 is formed by bending the middle of a metal pipe. Grips 49 are attached to the handle portions 9. The handle portions 9 are coupled to the top ends of the vertical frame portions 14 by swing coupling devices 28. The handle portions 9 are swingably coupled to the vertical frame portions 14 by the swing coupling devices 28.

(Side Plate 48)

Furthermore, the side frames 1 shown in FIGS. 1 and 2 include side plates 48 each of which is arranged between the elbow rest frame portion 12 and the middle frame portion 15, and closes the space between the interlinking frame portion 16 and the vertical frame portions 14. The front-side and rear-side edges of the illustrated side plate 48 are arranged near the interlinking frame portions 16 and the vertical frame portions 14, respectively. The lower edge of the side plate 48 is arranged near the middle frame portion 15.

(Folding Linkage 2)

When the user moves the right and left side frames 1 toward each other, the folding linkage 2 can keep the side frames 1 in their vertical orientation so that the wheelchair can be folded as shown in FIG. 5. When the user moves the right and left side frames 1 away from each other, the folding linkage 2 can unfold the wheelchair as shown in FIG. 3. As shown in FIGS. 1 to 3, the folding linkage 2 can include front-side and rear-side X-link portions 21. The X-link portion 21 includes two link rods 23. The two link rods 23 are coupled to the side frames 1. A pair of sublinks 22 is provided for the both side frames 1. Each of the sublinks 22 interlinks the middle of the upper part of the two link rods 23 with the side frame 1.

(X Link Portion 21)

As shown in FIG. 3, the two link rods 23 of the X-link portion 21 are arranged in an X shape, and are coupled to each other by a rotation shaft 24 so that they can rotate about the rotation shaft 24 in a vertical plane. More specifically, the central intersectional parts of the two link rods 23 are coupled to each other by the rotation axis 24. The X-link portion 21 lies in the vertical plane. The lower ends of the two link rods 23 of the X-link portion 21 are swingably coupled to the bottom frame portion 11. The upper ends of the two link rods 23 of the X-link portion 21 are swingably coupled to the seat frames 6. The front-side and rear-side X-link portions 21 are spaced away from each other in the fore-and-aft direction, and interlink the bottom frame portion 11 with the seat frame 6. As shown in FIGS. 1 and 2, the lower ends of the two link rods 23 of the X-link portions 21 that are coupled to one bottom frame portion 11 are fastened to a pivot cylinder portion 25. The pivot cylinder portion 25 is rotably coupled to the central part of the bottom frame portion 11 so that the two link rod 23 of the X-link portion 21 is swingably coupled to the bottom frame portion 11. The upper ends of the two link rod 23 of the front-side and rear-side X-link portions 21 that are coupled to one seat frame 6 is coupled to the seat frames 6. When the user moves the right and left side frames 1 toward each other, the X-link portions 21 can keep the bottom frame portions 11 and the seat frames 6 parallel to each other so that the wheelchair can be folded. When the user moves the side frames 1 away from each other, the X-link portions 21 can unfold the wheelchair.

As shown in FIG. 5, the seat frames 6 are positioned between the elbow rests 20, which are arranged on the upper surfaces of the opposed side frames 1, when the X-link portions 21 of the folding linkage 2 are folded by moving the side frames 1 toward each other. That is, the length of the link rods 23 is dimensioned so as to allow the seat frames 6 to approach the elbow rest frame portions 12 and raise the seat frames 6 to substantially the same height as the elbow rest frame portions 12 when the user moves the side frames 1 toward each other so that the wheelchair is folded. As shown in FIG. 3, according to the folding linkage 2, when the user moves the side frames 1 away from each other so that the wheelchair is unfolded, in other words, when the seat frames 6 is moved in the right-and-left direction away from each other so that the flexible seat 7 is unfolded, the seat frames 6 are positioned above the middle frame portions 15, and the seat frames 6 are supported by the support portions 27, which protrude upward from the middle frame portions 15.

(Sublink 22)

The sublinks 22 interlink the X-link portion 21 with the side frames 1, and can hold the side frames 1 in the vertical orientation. The right and left sublinks 22 are coupled to the X-link portion 21 in the folding linkage 2 that is arranged on the rear side. More specifically, the right and left sublinks 22 interlink the pair of link rods 23, which compose the X-link portion 21, with the pair of side frames 1. One end of the illustrated sublink 22 is coupled to the middle of the upper part of the link rod 23 of the X-link portion 21, in other words, to the point of the X-link portion 21 higher than the rotation shaft 24 so that the link rod 23 of the X-link portion 21 can rotate in a vertical plane about the rotation shaft 24. Another end of the sublink 22 is swingably coupled to the side frame 1. More specifically, in the illustrated wheelchair, another end of the sublink 22 is coupled to the axle portion 19, which is arranged on the vertical frame portion 14, by a pin 26 so that the sublink 22 can swing in the vertical plane. The sublinks 22 allow the side frames 1 to move toward or away from each other while keeping them in their vertical orientation. Since the illustrated folding linkage 2 includes the pair of sublinks 22, which are arranged on the right and left sides, the right and left side frames 1 can be stably held in their vertical orientation when the wheelchair is unfolded.

(Seat 5)

The seat 5 of the wheelchair is constructed of the folding linkage 2 and the flexible seat 7, and arranged between the right and left side frames 1. The both sides of the flexible seat 7 of the seat 5 are coupled to the seat frames 6, which are coupled to the upper ends of X-link portions 21 of the folding linkage 2. The flexible seat 7 is folded when the right and left side frames 1 are moved toward each other and the wheelchair is brought in a loose state as shown in FIG. 5. The flexible seat 7 can be held under tension and serves as the seat 5 when the right and left side frames 1 are moved away from each other and the wheelchair is brought in a tensioned state as shown in FIG. 3.

(Backrest Sheet 29)

The wheelchair shown in FIGS. 1 to 3 includes a backrest sheet 29 which is arranged on the back side of the seat 5. The both sides of the backrest sheet 29 are coupled to the right and left vertical frame portions 14 and the right and left handle portions 9. The both ends of the upper part of the illustrated backrest sheet 29 are coupled to the handle portions 9. The both ends of the lower part of the illustrated backrest sheet 29 are coupled to the vertical frame portions 14. When the right and left side frames 1 are moved away from each other, the backrest sheet 29 expands from the loose state into the tensioned state, and serves as a backrest of the user who sits on the seat 5. The backrest sheet 29 is loosened when the side frames 1 is moved toward each other. In the wheelchair shown in FIG. 2, the vertical frame portions 14 and the handle portions 9 are inclined rearward so that their top ends are positioned on the rear side with respect to their bottom ends. As a result, the backrest surface is slightly inclined. According to this arrangement, the user can lean on the backrest sheet 29 and sit on the seat 5 in a comfortable position.

(Footrest 8)

The wheelchair shown in FIGS. 1 to 5 includes the pair of footrests 8 in front of the seat 5. The footrests 8 can support wheelchair user's feet when the user is sitting on the seat 5. Each of the footrests 8 includes a footrest arm 41 which is coupled to the exterior-side surface of the front part of the side frame 1, and a footrest plate 42 which is attached to the fore end of the footrest arm 41. The footrest arm 41 shown in FIGS. 1 and 2 is swingably coupled to the front frame portion 13 and moves in the vertical plane containing the fore-and-aft direction when folded. More specifically, the base end part of the footrest arm 41 is coupled to the front frame portion 13 by a pivot shaft 43. The illustrated footrests 8 can turn about the pivot shafts 43 rearward, and be folded and orientated in their vertical orientations.

The footrest plates 42 are coupled to the free ends of the footrest arms 41 by rotation shafts 46 so as to be able to swing between their horizontal and vertical positions. In the horizontal position, the user can place his/her feet on the upper surfaces of the footrest plates 42. In the vertical position, the upper surfaces of the footrest plates 42 will be brought in contact with the footrest arm 41. According to the footrests 8, the footrest plates 42 can be folded by turning the footrest plates 42 to their vertical orientations and subsequently turning the footrest arms 41 rearward. When folded, the footrest plates 42 are held in the accommodation space portions 18. Also, according to the footrests 8, when the footrest arms 41 are turned frontward and the footrest plates 42 are unfolded, the user can place his/her feet on the upper surfaces of the footrest plates 42.

However, the present invention is not limited to such a foldable wheelchair which includes foldable footrests, and can be applied to a wheelchair which includes unfoldable footrests 8 fixed to the both side frames.

(Driving Wheel 3)

The driving wheels 3 are rotatably mounted to the exterior-side surfaces of the side frames 1. In the wheelchair shown in FIG. 1, the axles (not shown), which serve as the rotation axes of the driving wheels 3, are coupled to the lower parts of the vertical frame portions 14 of the side frames 1. The axle portions 19 are fixed to the lower parts of the vertical frame portions 14 of the side frames 1. The axles are fixed to the axle portions 19. The axles, which are fixed to the both right and left side frames 1, are aligned in one straight line. The reason is to arrange the pair of driving wheels 3 at the symmetrical positions in the exterior sides of the side frames 1.

As shown in FIGS. 6 to 9, each of the driving wheels 3 includes the rim portion 32, the hub portion 33, the hand rim 35, and the fastening members 50. The rim portion 32 holds the tire 31 on the outer peripheral part of the rim portion 32. The hub portion 33 is arranged at the center of the rim portion 32 and coupled to the rim portion 32 by the connecting members 34. The hand rim 35 is arranged on the exterior side of the rim portion 2, which is opposite to the side frame 1. The fastening members 50 fasten the hand rim 35 to the rim portion 32.

(Rim Portion 32)

The rim portion 32 has an annular shape. A recessed part 32A circumferentially extends along the outer peripheral part of the rim portion 32. The illustrated rim portion 32 is formed from metal. It is noted that the rim portion may be formed from hard plastic. The tire 31 is firmly attached to the rim portion 32 by fitting the inner peripheral parts of the tire 31 in the recessed part 32A. The tire 31 can be a rubber tube filled with air, for example. However, the tire is not limited to the structure to be filled with air. A cushioning ring formed of solid rubber, plastic, or the like which serves as the tire may be fitted in the recessed part of the rim portion.

(Hub Portion 33)

Figure 6:
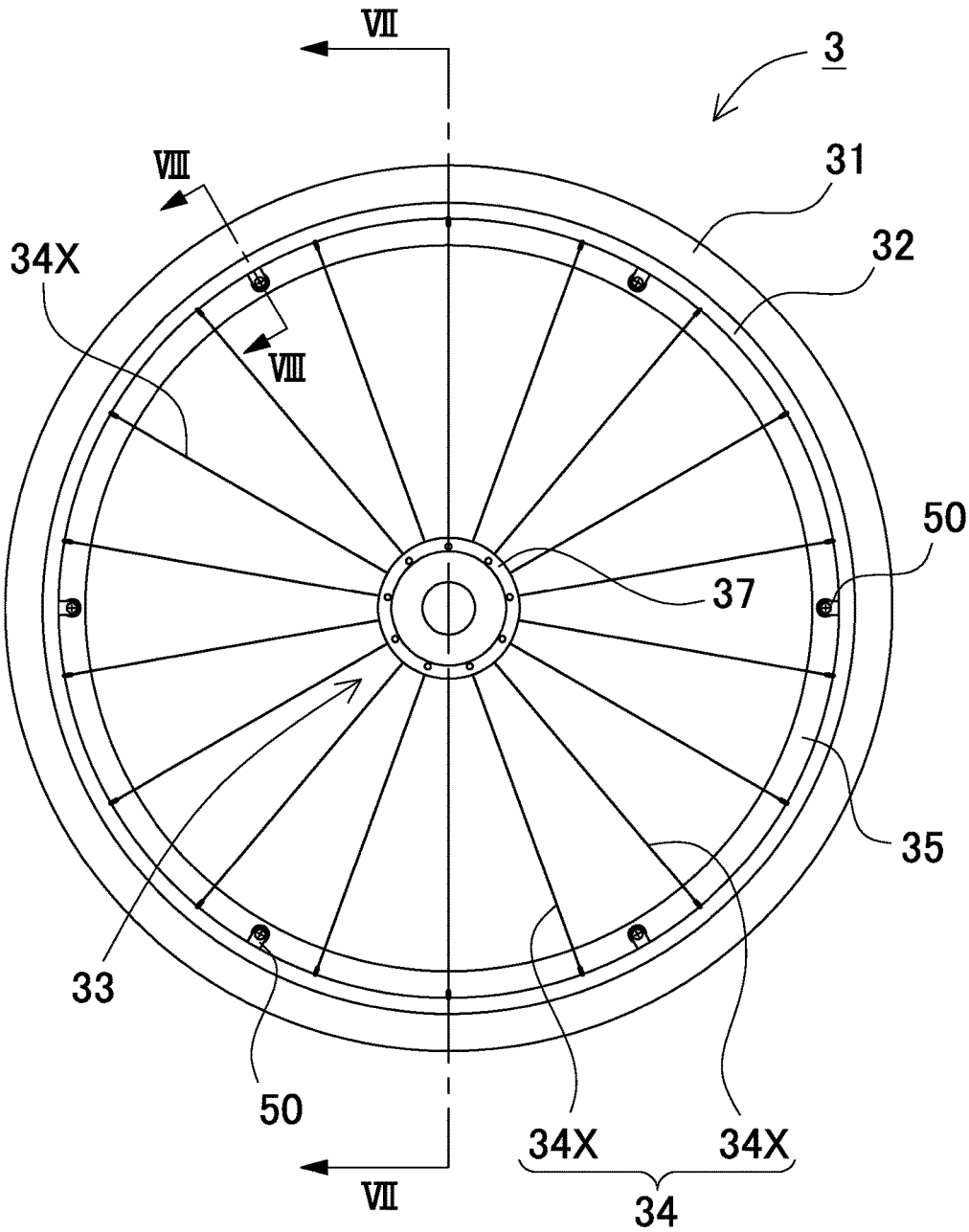
FIG. 6 is a front view showing a driving wheel of the wheelchair shown in FIG. 3 as viewed from the interior side.
Figure 7:
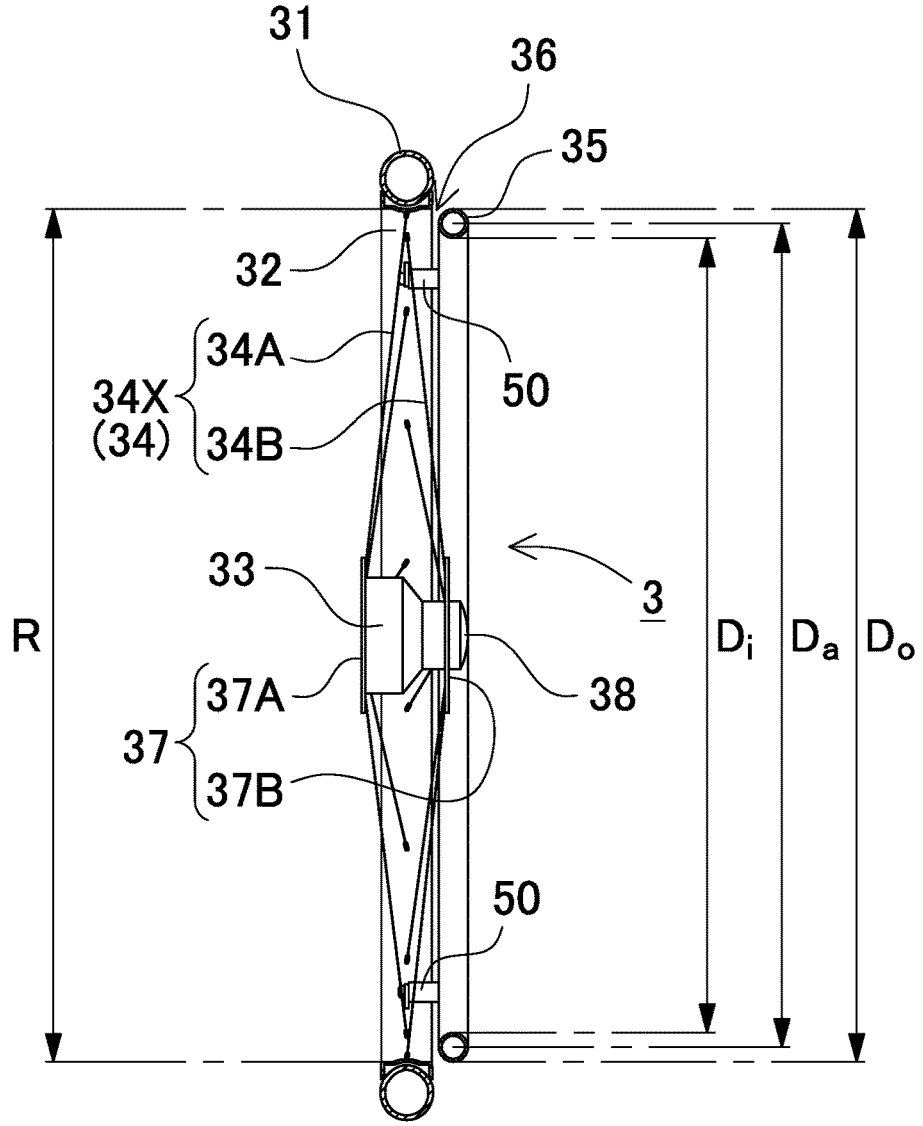
FIG. 7 is a cross-sectional view showing the driving wheel shown in FIG. 6 taken along a line VII-VII.

The hub portion 33 is arranged at the center of the driving wheel 3, and is coupled to the annular rim portion 32 by the connecting members 34. The illustrated connecting members 34 are metal spokes 34X. The hub portion 33 shown in FIGS. 6 and 7 is coupled to the rim portion 32 by a number of spokes 34X. The hub portion 33 includes a pair of flanges 37 on both side ends of the hub portion 33. The spokes 34X radially extend from the flanges 27. One end of each of the spokes 37 is coupled to one of the flange portions 37. Another end of each of the spokes 34X, which radially extend from the hub portion 33, is coupled to the inner peripheral surface of the rim portion 32.

The flanges 37 of the hub portion 33 shown in FIG. 7 are first and second flange 37A and 37B which are arranged on the interior and exterior sides of the driving wheel 3, respectively, and are orientated parallel to each other. A first set of spokes 34A (also referred to first spokes 34A) and a second set of spokes 34B (also referred to second spokes 34B) are included as the spokes 34. The first spokes 34A are coupled to the first flange 37A of the hub portion 33. The second spokes 34B are coupled to the second flange 37B of the hub portion 33. The first spokes 34A and the second spokes 34B are alternately arranged. In this driving wheel 3, the lengths of the first and second spokes 34A and 34B of are equal to each other. As a result, the center plane as a vertical plane which passes through the center of the hub portion 33 in the width direction agrees with a vertical plane which passes through the center of the rim portion 32 in the width direction.

The hub portions 33 is rotably coupled to the wheelchair body 10. More specifically, the hub portions 33 are rotably coupled to the axles (not shown), which are fixed to the axle portion 19 of the side frame 1, through bearings (not shown) which are arranged inside the hub portions 33. The hub portions 33 are coupled to the axles through the bearings so as not to be out of place. The illustrated hub portion 33 has a stepped drum shape which has interior-side and the exterior-side outer diameters different from each other. The interior-side inner diameter is greater than the exterior-side inner diameter. Brake mechanisms (not shown) of assistance brakes 65 are arranged inside the interior-side parts of the hub portions 33 as discussed later.

The connecting members 34, which interlink the rim portion 32 with the hub portion 33, are not limited to the spokes 34X. One disc or a plurality of arms which are coupled to the hub portion may serve as the connecting member. In this driving wheel, a wheel portion can be formed of the hub portion, the connecting member, and the rim portion. The tire can be attached to the outer peripheral part of the wheel portion. The rim portion, the connecting member, and the hub portion of this wheel portion can be integrally formed from plastic or metal.

The driving wheel 3 shown in FIGS. 6 and 7 includes an axle-covering member 38 which is formed from rubber and is arranged on the exterior-side surface of the hub portion 33. The axle-covering member 38 can protect a fastening member (not shown) which is coupled to the end of the axle. Accordingly, the fastening member can be prevented from loosening or being out of place. Since the looseness of the fastening member can be prevented for a long period of use, the handling of the wheelchair can be stable. The appearance is improved by covering the fastening members for fastening the axles with the axle-covering members 38. Also, the axle-covering members 38 can effectively prevent direct contact between the user or his/her assistant and the fastening members, which protrude from the wheels. The axle-covering members 38 are formed from black rubber or plastic. In this case, since the black axle-covering member 38 can attract attention to its location, the entire appearance of the wheelchair can be further improved by the black axle-covering member 38.

(Hand Rim 35)

Figure 8:
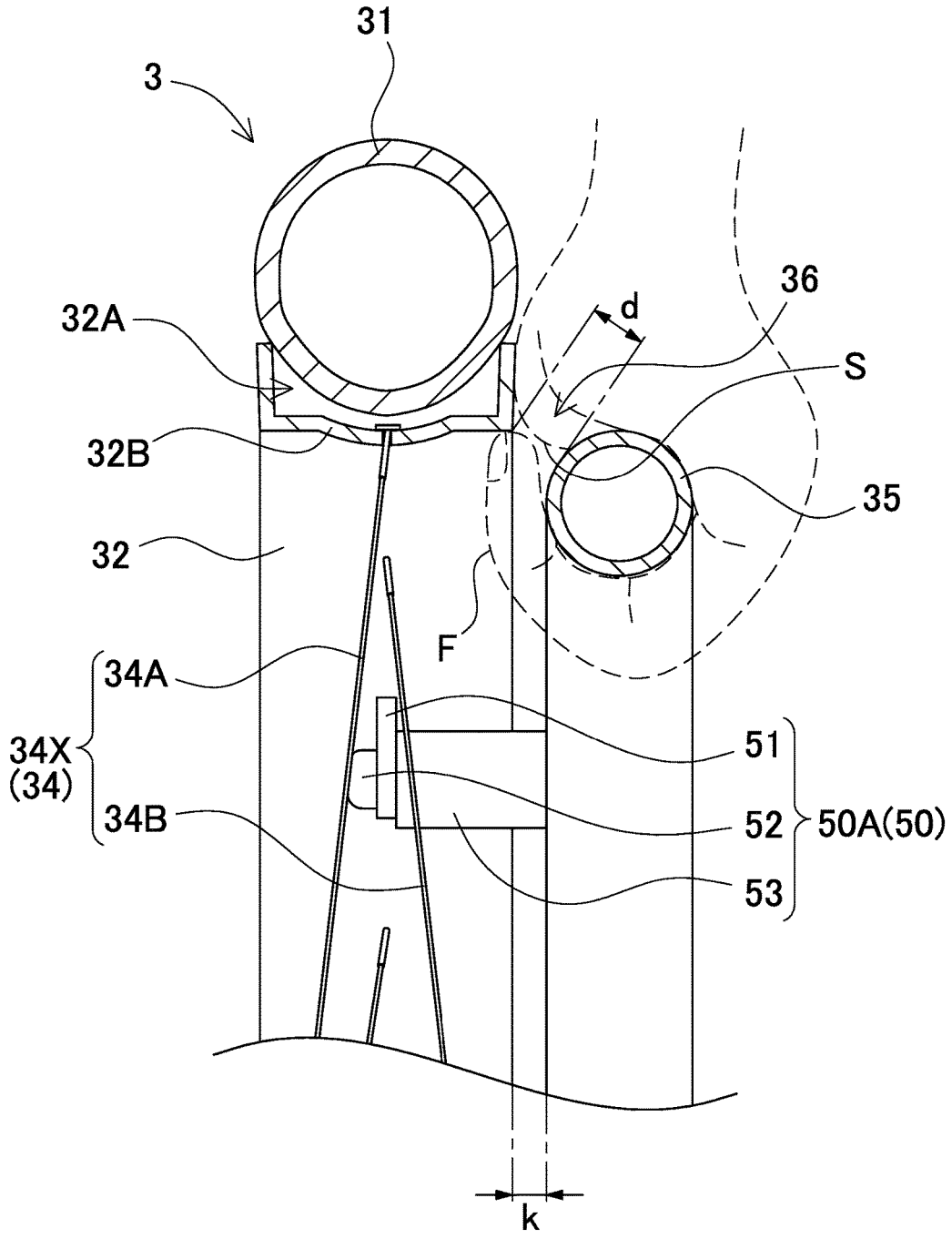
FIG. 8 is an enlarged cross-sectional view of a hand rim of the driving wheel taken along a line VIII-VIII line of FIG. 6 with user's hand grasping the hand rim.
Figure 9:
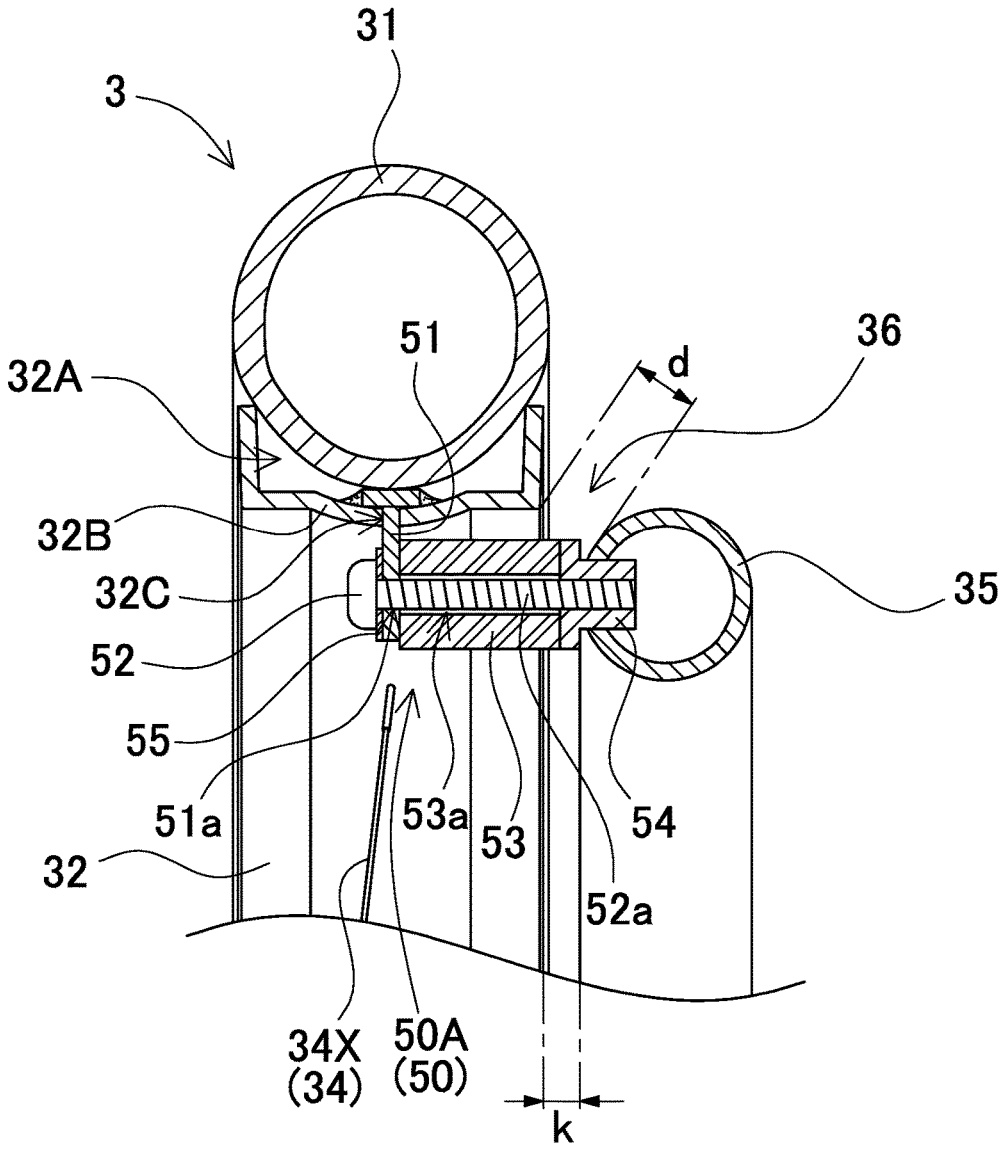
FIG. 9 is a cross-sectional view showing the driving wheel shown in FIG. 6 taken along a line IX-IX.

The hand rims 35 are rings which are arranged on the both exterior-side surfaces of the wheelchair, more specifically on the exterior sides of the driving wheels 3. The user can rotate the driving wheels 3 by pushing on the hand rims 35 by hand when sitting on the seat 5. The hand rim 35 shown in FIGS. 7 to 9 is formed of metal. More specifically, the hand rim 35 is constructed of an annular metal hollow tube. In the case where the hand rim is constructed of a metal hollow tube, the hand rim can have sufficient strength and reduce the entire weight of the wheelchair. The annular hand rim 35 has a circular outer shape which arranged along the rim portion 32 of the driving wheel 3. The illustrated hand rim 35 has a smooth circular exterior surface. The distance between the hand rim 35 and the rim portions 32 is constant along circumference of the rim portion 32 when the hand rim 35 is mounted to the rim portion 32.

The metal tube of the hand rim 35 shown in FIG. 8 has a circular shape in transverse cross section. The hand rim 35 can provide good appearance, and suppress its outward protruding amount. However, the cross-sectional shape of the hand rim is not limited to such a circular shape but can be an ellipse shape, an oblong shape, or a roughly circular shape which is obtained by slightly deforming a perfect circle.

(Insertion Prohibition Spacing 36)

In the driving wheel 3, the hand rim 35 is arranged in proximity to the rim portion 32 so that the insertion prohibition spacing 36, which has a distance capable of prohibiting insertion of user's thumb S into this insertion prohibition spacing 36, is formed between the rim portion 32 and the hand rim 35. According to the wheelchair of the present invention, the hand rim 35 is arranged in proximity to the rim portion 32, but the hand rim 35 is not in contact with the rim portion 32 and is spaced at a predetermined distance away from the rim portion so that the insertion prohibition spacing 36 is formed which has a distance capable of prohibiting insertion of user's thumb S into this insertion prohibition spacing. The insertion prohibition spacing 36 is dimensioned to prevent user's thumb S from passing through the space between the rim portion 32 and the hand rim 35 from the outer side and inserting into this insertion prohibition spacing when the user grasps the hand rim 35. The distance between the hand rim 35 and the rim portion 32 is substantially constant along the entire circumference of the rim portion 32, and is dimensioned to prohibit insertion of user's thumb S into the space between the hand rim 35 and the rim portion 32 when the user pushes on the hand rims 35 by hand.

In this specification, the term "a distance capable of prohibiting insertion of user's thumb" refers to a distance that can prohibit accidental insertion of user's thumb S when the user grasps the hand rims 35 but allows intentional forced insertion of user's thumb S. The distance (d) of the insertion prohibition spacing 36 can be dimensioned equal to or slightly greater than the thickness of user's thumb S. Specifically, the distance (d) of the insertion prohibition spacing 36 can be not greater than 25 mm, preferably not greater than 20 mm, and more preferably not greater than 18 mm. Since the insertion prohibition spacing 36, which has a distance capable of prohibiting insertion of user's thumb S into this insertion prohibition spacing 36, is formed between the rim portion 32 and the hand rim 35, this arrangement can surely prevent insertion of user's thumb S into the insertion prohibition spacing 36 when the user unintentionally grasps the hand rims 35. This wheelchair can surely prevent injuries to user's thumb S when the user pushes on the hand rims 35, and can therefore be safely used.

Also, the distance (d) of the insertion prohibition spacing 36 of the driving wheel 3 can be dimensioned to be able to prohibit insertion of user's finger F other than his/her thumb into this insertion prohibition spacing. In this case, user's fingers F (other than his/her thumb) can additionally be protected. For example, as shown in FIG. 8, when the user is grasping the upper part of the hand rim 35 by hand, user's fingers F moves along the lower surface of the hand rim 35 and are often inserted into the space inside the hand rim 35. In the case where the distance (d) of the insertion prohibition spacing 36 is dimensioned to be able to prohibit insertion of user's finger F (other than his/her thumb) into this insertion prohibition spacing, user's fingers F are prevented from inserting into this insertion prohibition spacing. Therefore, it is possible to effectively prevent the user from strongly grasping the hand rim 35.

Similar to the case of the term "a distance capable of prohibiting insertion of user's thumb", in this specification, the term "the distance is dimensioned to be able to prohibit insertion of user's finger into this insertion prohibition spacing" refers to a distance that can prohibit accidental insertion of user's finger F (other than his/her thumb) when the user grasps the hand rims 35 but allows intentional forced insertion of user's finger F. The distance (d) of the insertion prohibition spacing 36 can be dimensioned equal to or slightly greater than the thickness of user's finger F (other than his/her thumb). When the user grasps the hand rim 35 with his/her fingers F (other than his/her thumb), from the viewpoint of the lengths of fingers, the fore end of any of his/her index, middle and ring fingers will approach the insertion prohibition spacing 36. For this reason, the distance (d) of the insertion prohibition spacing 36 can be dimensioned equal to or slightly greater than the thicknesses of user's fingers F other than his/her little finger. Specifically, the distance (d) of the insertion prohibition spacing 36 that is dimensioned to be able to prohibit insertion of user's finger into this insertion prohibition spacing can be not greater than 15 mm, preferably not greater than 12 mm, and more preferably not greater than 10 mm. Since the insertion prohibition spacing 36, which has a distance capable of prohibiting insertion of user's finger F (other than his/her thumb) into this insertion prohibition spacing 36, is formed between the rim portion 32 and the hand rim 35, this arrangement can surely prevent insertion of user's fingers F into the insertion prohibition spacing 36 when the user unintentionally grasps the hand rims 35. This wheelchair can surely prevent injuries to any of user's thumb and fingers when the user pushes on the hand rims 35, and can therefore be safely used.

Generally, the thumb and fingers of a human hand are tapered down to their fore ends. From this viewpoint, even in the case where the distance (d) of the insertion prohibition spacing 36 is smaller than smaller than the thickness of the fingers, the fore end of the finger may be partially inserted into the space between the rim portion 32 and the hand rim 35. However, even if the fore ends of user's thumb and fingers are shallowly inserted into the space, the user cannot strongly grasp the hand rim 35. Consequently, user's thumb and fingers are unlikely to be damaged in rotation of the driving wheel 3. For this reason, in this specification, whether user's finger (or thumb) passes through the insertion prohibition spacing 36 can be determined based on whether the first joint of the finger (or thumb) passes through the insertion prohibition spacing 36. In other words, the distance capable of prohibiting insertion of user's finger (or thumb) into the insertion prohibition spacing 36 can be defined based on whether the first joint of the finger (or thumb) passes through the insertion prohibition spacing 36.

Insertion of user's finger F into the insertion prohibition spacing 36 can be prevented not only by the distance of the insertion prohibition spacing 36, which is formed between the rim portion 32 and the hand rim 35, but also by the positional relationship between the rim portion 32 and the hand rim 35 in the driving wheel 3. For example, in the case where the gap (k) in the width direction between the hand rim 35 and the rim portion 32 of the driving wheel 3 is small, insertion of user's finger F (other than thumb) into the space between the rim portion 32 and the hand rim 35 can be prevented. In this specification, the gap (k) in the width direction between the hand rim 35 and the rim portion 32 refers to the transverse interval between the interior-side surface of the hand rim 35 and the exterior-side surface of the rim portion 32 as shown in FIG. 8.

In the driving wheel 3 shown in FIG. 8, the gap (k) in the width direction between the hand rim 35 and the rim portion 32 is dimensioned smaller than the thickness of user's finger F. According to this driving wheel 3, even if the user will unwittingly grasp the upper part of the hand rim 35 so that user's fingers F (other than thumb) are being inserted from the bottom side into the gap on the interior side of the hand rim 35, this arrangement can effectively prevent insertion of the fore ends of his/her fingers F into the insertion prohibition 36. The reason is that the gap (k) in the width direction between the hand rim 35 and the rim portion 32 is dimensioned small, and as a result the fore ends of user's fingers F under the insertion motion from the bottom side toward the interior side of the hand rim 35 are likely to contact the inner peripheral surface of the rim portion 32. Consequently, it is possible to effectively prevent the fore ends of the fingers F, which are under the insertion motion from the bottom side, from directly moving into the insertion prohibition spacing 36. Therefore, according to this driving wheel 3, even in the case where the distance (d) of the insertion prohibition spacing 36 is dimensioned slightly larger than the thickness of the fingers F, it is possible to effectively prevent user's fingers F from passing through the insertion prohibition spacing 36 when his/her fingers are being inserted from the bottom side of the hand rim 35. Specifically, the gap (k) in the width direction between the hand rim 35 and the rim portion 32 can be not greater than 20 mm, preferably not greater than 15 mm, and more preferably not greater than 10 mm. In particular, in the case where the gap (k) in the width direction between the hand rim 35 and the rim portion 32 is dimensioned small, the width in the right-and-left direction of the wheelchair can be small.

The hand rim 35 is not in contact with the rim portion 32, and is spaced at a predetermined distance away from the rim portion 32. The reason is that if the hand rim 35 is too close to the rim portion 32, it will be difficult for the user to grasp the hand rim 35. Specifically, the distance (d) of the insertion prohibition spacing 36 can be not smaller than 1 mm, and preferably not smaller than 3 mm.

In the case where the insertion prohibition spacing 36 is small, the width of the wheelchair can be reduced by reducing the protruding amount of the hand rim 35 toward the exterior side, and accidental insertion of user's fingers into the insertion prohibition spacing 36 can be surely prevented. However, if the insertion prohibition spacing 36 is too small, it will be difficult for the user to grasp the hand rims 35 when pushing on the hand rims 35. Contrary to this, if the insertion prohibition spacing 36 is large, the protruding amount of the hand rim 35 toward the exterior side correspondingly becomes large, and as a result the user can easily grasp hands rim 35 when pushing on the hand rims 35. However, the user's fingers are likely to be accidentally inserted into the insertion prohibition spacing 36. In case of accidental insertion, user's fingers may be damaged. From this viewpoint, the distance of the insertion prohibition spacing 36 is dimensioned to fall within the above range, which can prevent accidental insertion of user's fingers into the insertion prohibition spacing 36 when the user is grasping to the hand rim.

The possibility of insertion of user's fingers into the space between the rim portion 32 and the hand rim 35 will vary depending on the size of the user's hand, the thickness, and the shape of user's finger, and the like. That is, this possibility will vary depending on the sex, age, build, and the like of the user who uses the wheelchair. For this reason, the distance (d) of the insertion prohibition spacing 36 and the gap (k) in the width direction between the hand rim 35 and the rim portion 32 can be modified to various sizes depending on the user who uses the wheelchair.

As shown in FIG. 7, the average diameter (Da) of the hand rim 35 is dimensioned smaller than the inner diameter (R) of the rim portion 32 of the driving wheel 3. In this specification, the average diameter (Da) of the hand rim 35 refers to the average of the outer diameter (Do) and the inner diameter (Di) of the hand rim 35. As shown in FIG. 7, in the case where the tubular hand rim 35 has a circular shape in cross section, the average diameter (Da) of the hand rim 35 can be defined by the center diameter of the tubular hand rim, which is the distance between the center points of the circular shapes in cross section taken along the line passing through the center of the tubular hand rim. In the case where the average diameter (Da) of the hand rim 35 is smaller than the inner diameter (R) of the rim portion 32, the hand rim 35 can be arranged further inward of the wheelchair 3 although the insertion prohibition spacing 36 is formed between the rim portion 32 and the hand rim 35. Therefore, the width of the wheelchair can be reduced. Also, in the case where the average diameter of the hand rim 35 is small, in other words, the hand rim 35 is arranged on the center side of the driving wheel 3 relative to the rim portion 32, it is possible to effectively prevent user's hands from directly touching the tires 31 when pushing on the hand rims 35 by hand.

The outer diameter (Do) of the hand rim 35 shown in FIGS. 7 to 9 is dimensioned substantially equal to the inner diameter (R) of the rim portion 32 of the driving wheel 3. That is, the outer peripheral surface of the hand rim 35 lies on the substantially same imaginary cylindrical surface as the inner peripheral surface of the rim 32 of the driving wheel 3. It is noted that the outer diameter (Do) of the hand rim 35 can be dimensioned slightly greater or smaller than the inner diameter (R) of the rim portion 32.

(Fastening Member 50)

The aforementioned hand rim 35 is arranged at a predetermined position of the rim portion 32 when coupled to the rim portion 32 by the fastening members 50. In the driving wheel 3 shown in FIG. 6, six fastening members 50 are spaced at a constant interval away from each other along the inner peripheral surface of the rim portion 32. However, the number of the fastening members 50 can be any number between three and eight. The fastening member 50 shown in FIG. 6 is arranged at the midpoint between the spokes 34X adjacent to each other. The fastening member 50 shown in FIGS. 7 and 9 substantially extends in the horizontal direction. A first end of the fastening member 50 is fastened to the interior-side surface of the hand rim 35, and a second end of the fastening member 50 is fastened to the inner peripheral surface of the rim portion 32. The length of this fastening member 50 can be minimized which interlinks the hand rim 35 with the rim portion 32. Since the fastening members 50 orientate in the horizontal position, the hand rim 35 can be correctly arranged at the predetermined position with respect to the rim portion 32. It is noted that the fastening members may be slightly inclined.

The hand rim 35 is fastened by the fastening members 50 at the predetermined position which is spaced at the predetermined gap (k) away from the rim portion 32. The insertion prohibition spacing 36 with the predetermined distance (d) is formed between the rim portion 32 and the hand rim 35 when the hand rim 35 is fastened by the fastening members 50 at the predetermined position with respect to the rim portion 32. The fastening members 50 can have a structure which holds the hand rim 35 at only one particular position. However, as shown in FIG. 9 and FIG. 10, the fastening members 50 can have a structure which makes the position of the hand rim 35 adjustable in the width direction of the wheelchair.

Figure 10:
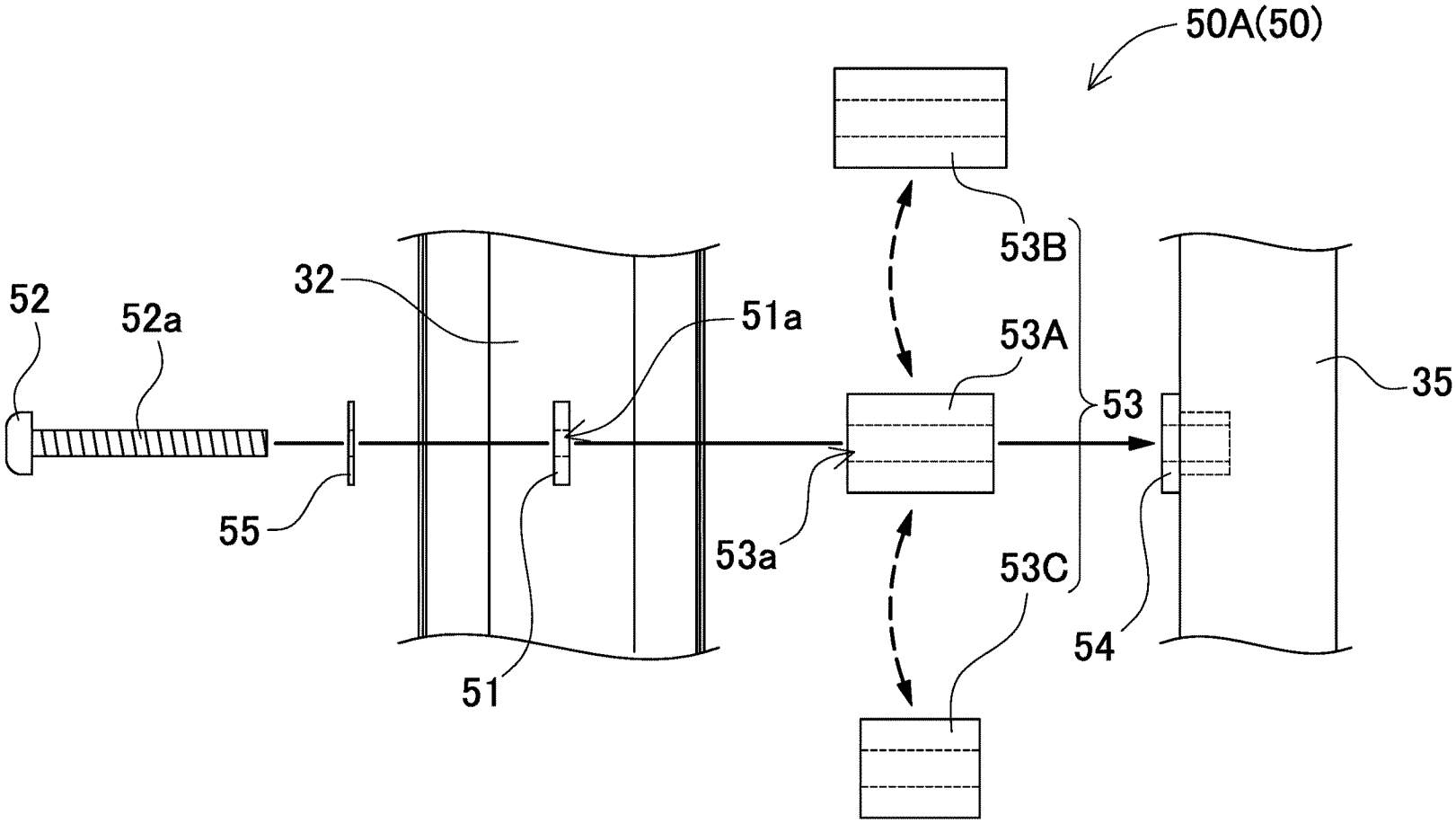
FIG. 10 is an exploded plan view of a fastening member of the driving wheel shown in FIG. 9.

The fastening member 50 shown in FIGS. 9 and 10 includes a fastening piece 51, a fastening screw 52, a cylindrical spacer 53, and a nut 54. The fastening piece 51 protrudes from the inner peripheral surface toward the center of the rim portion 32. The fastening screw 52 passes through the fastening piece 51, and protrudes toward the exterior side of the driving wheel 3. The cylindrical spacer 53 is arranged between the fastening piece 51 and the hand rim 35. The shank part 52*a* of the fastening screw 52 is inserted into the cylindrical spacer 53. The nut 54 is fastened to the interior side of the hand rim 35, and threadedly engages the fastening screw 52.

The fastening piece 51 protrudes from the central part of the inner peripheral surface toward the center of the rim portion 32. The fastening piece 51 shown in FIG. 9 is a metal plate or block which has an inverted T shape in cross section. A through hole 51*a* is formed in a main body of the fastening piece 51. The main body protrudes through an insertion hole 32C which is opened in the inner peripheral surface of the rim portion 32. Convex parts 32B are formed at the central parts along the inner peripheral surface of the illustrated rim portion 32. The central part of the convex parts 32B bulges toward the center of the rim portion 32. The insertion hole 32C is formed in the central part of the convex part 32B. The fastening piece 51 is inserted into the insertion hole 32C. The fastening screw 52 passes through the fastening piece 51 from the interior side to the exterior side of the driving wheel 3.

The fastening screw 52 passes through a washer 55, the fastening piece 51, and the cylindrical spacer 53. The end of the fastening screw 52 is screwed into the hand rim 35. The nut 54 is fixed to the inner peripheral surface of the illustrated hand rim 35. More specifically, the fastening screws 52 are screwed into the nuts 54. As a result, the hand rim 35 is fastened to the rim portion 32. The nut 54 has an internal threaded hole into which the fastening screw 51 is screwed. The nut 54 is embedded in and fixed to the interior-side surface of the hand rim 35.

The cylindrical spacer 53 has a central through hole 53*a* which extends in its axial direction. The shank part 52*a* of the fastening screw 52 is inserted into the central through hole 53*a*. The cylindrical spacer 53 is arranged between the fastening piece 51 and the hand rim 35. When the end of the fastening screw 52 is inserted into the central through hole 53*a*, and is screwed into the nut 54 of the hand rim 35, the hand rim 35 is fastened at the predetermined position. According to the fastening members, as shown in FIG. 10, the position of the hand rim 35 can be easily changed with respect to the rim portion 32 by selecting the length of the cylindrical spacer from the cylindrical spacers 53A, 53B and 53C into which the fastening screw 52 is inserted.

(Modified Fastening Member)

Figure 11:
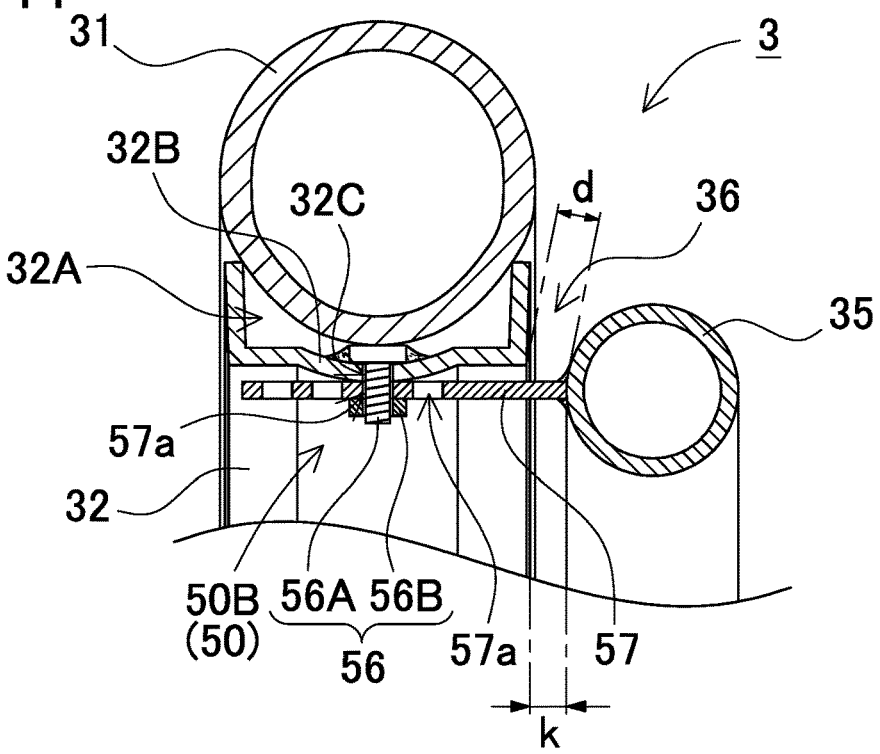
FIG. 11 is an enlarged cross-sectional view showing a fastening member of a driving wheel according to another example.

The fastening members 50 can have the structure shown in FIG. 11. The illustrated fastening member 50B includes a fastening arm 57, and a fastener 56. A first end of the fastening arm 57 is fastened to the hand rim 35, and a second end of the fastening arm 57 is fastened to the inner peripheral surface of the rim portion 32. The fastener 56 fastens the second end of the fastening arm 57 to the inner peripheral surface of the rim portion 32. The illustrated fastening arm 57 has an elongated plate shape having a predetermined thickness. The first end of the fastening arm 57 is fixed to the hand rim 35 by welding. A plurality of through holes 57*a* are formed and aligned in one straight line in the second end part of the fastening arm 57. The fastening member 50B is fastened to the inner peripheral surface of the rim portion 32 by a fastener 56. The fastener 56 is inserted into one of the through holes 57*a*, which are arranged in the fastening arm 57. The illustrated fastener 56 includes a fastening screw 56A, and a nut 56B. The fastening screw 56A is inserted into the insertion hole 32C, which is formed in the central part of the convex part 32B of the rim portion 32. The fastening screw 56A is screwed into the nut 56B. The fastening screw 56A of the fastener 56 passes through the convex part 32B from the outer peripheral side toward the center of the rim portion 32, and is inserted into the through hole 57*a* of the fastening arm 57. The end of the fastening screw 56A protrudes from the through hole 57*a*, and is screwed into the nut 56B. As a result, the fastening arm 57 is fastened at the predetermined position to the rim portion 32.

Figure 12:
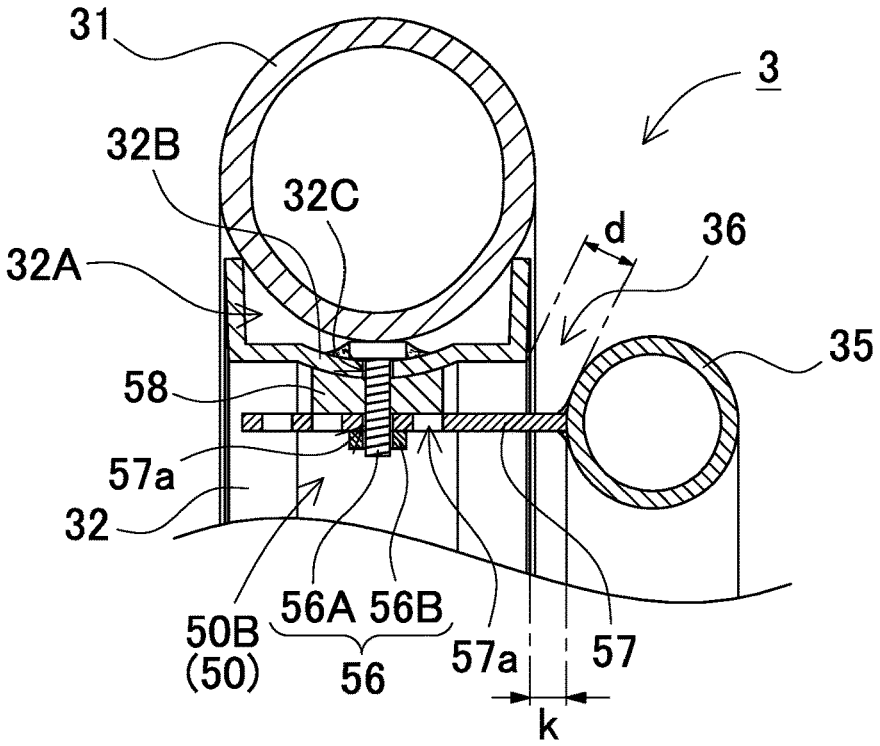
FIG. 12 is an enlarged cross-sectional view showing a fastening member of a driving wheel according to still another example.

The distance between the rim portion 32 and the hand rim 35 can be changed by selecting one of the through holes 57*a* of the fastening arm 57 into which the fastening screw 56A is inserted. As a result, the fastening members 50B can provide the insertion prohibition spacing 36 that has a suitable distance between the hand rim 35 and the rim portion 32. The fastening arm 57 is in contact with the inner peripheral surface of the rim portion 32 when the fastening member 50B shown in FIG. 11 is coupled to the rim portion 32. In a modified example shown in FIG. 12, a spacer 58 with a predetermined thickness is arranged between the fastening arm 57 and the inner peripheral surface of the rim portion 32. The spacer 58 shown in FIG. 12 has a concave shape. The concave shape is formed on the surface of the spacer 58 which faces the inner peripheral surface of the rim portion 32, and matches the convex surface of the convex part 32B of the rim portion 32. In the case where the spacer 58 is arranged between the fastening arm 57 and the inner peripheral surface of the rim portion 32, the hand rim 35 can be shifted toward the center of the driving wheel 3 relative to the example shown in FIG. 11, in other words, the outer diameter of the hand rim 35 can be smaller than the example shown in FIG. 11. That is, the hand rim 35 can be arranged radially inward.

In the wheelchair according to the foregoing embodiments, the hand rim 35 of the driving wheel 3 is constructed by forming a metal pipe into a ring shape. However, the hand rim is not limited to metal but can be formed of resin. The hand rim formed of resin has a ring shape as a whole, and can include parts of the fastening members. For example, in the case where the fore ends of the fastening screws are screwed into the hand rims shown in FIGS. 9 and 10, internal threaded holes may be formed as nut parts on the interior side of the hand rim formed of resin. In the case where the coupling arms are coupled to the hand rims shown in FIGS. 11 and 12, the coupling arms can be integrally formed with the resin hand rims in molding.

(Modified Driving Wheel)

Figure 13:
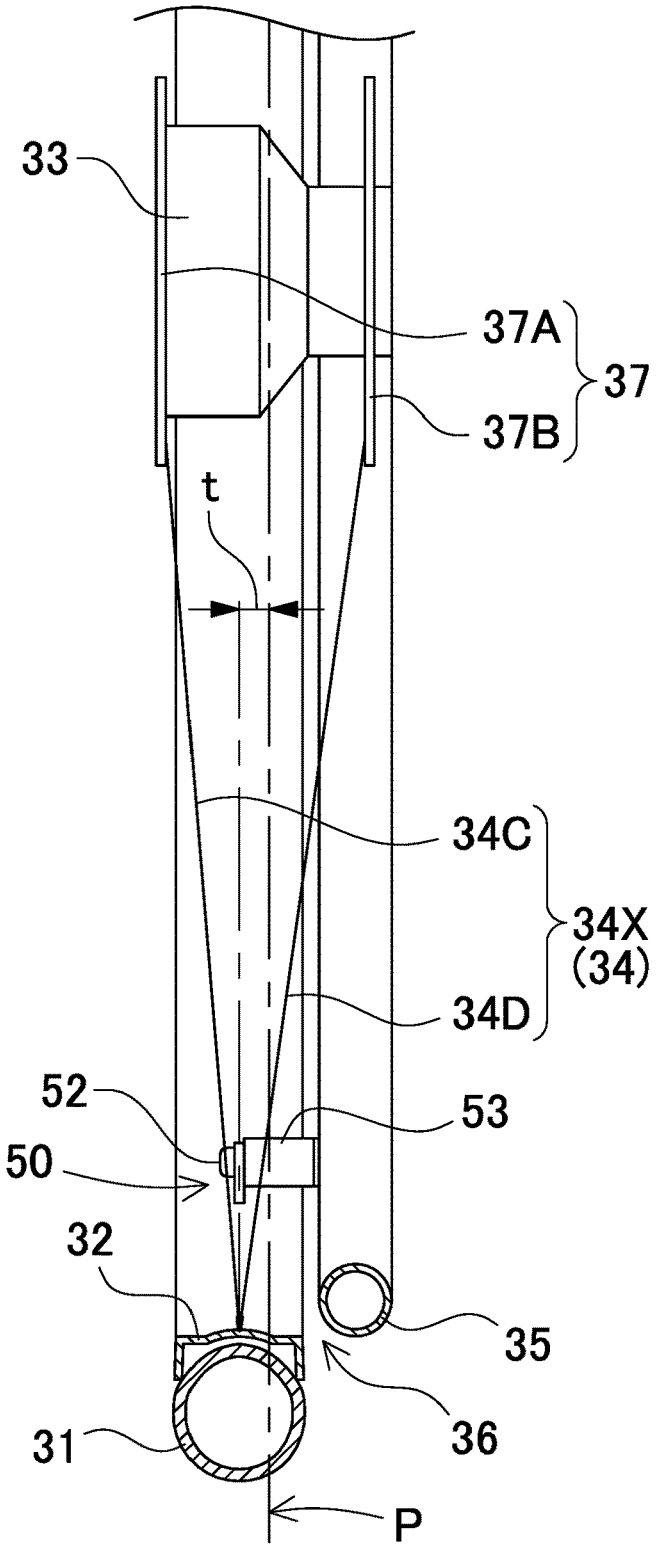
FIG. 13 is an enlarged cross-sectional view showing a driving wheel according to another embodiment.
Figure 14:
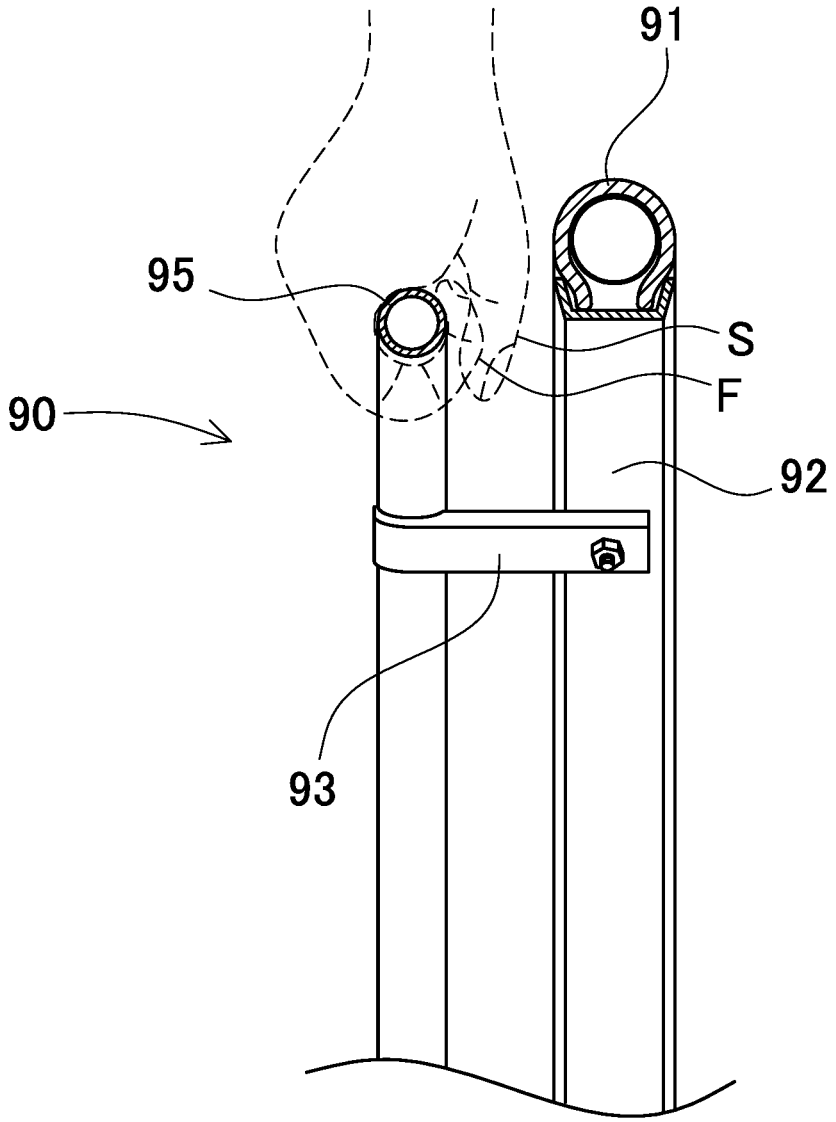
FIG. 14 PRIOR ART
FIG. 14 is a schematic cross-sectional view showing a hand rim of a driving wheel according to a conventional wheelchair with user's hand grasping the hand rim as viewed from the front side.
Figure 15:
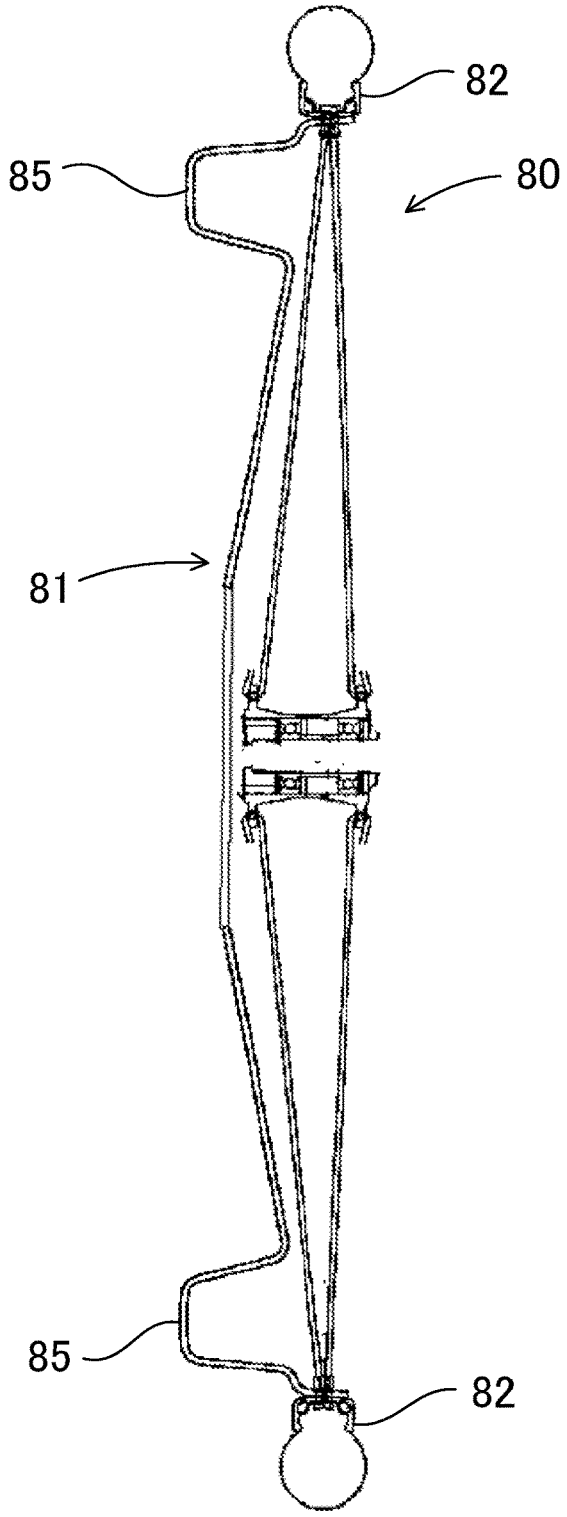
FIG. 15 PRIOR ART
FIG. 15 is a cross-sectional view showing a driving wheel of a known wheelchair.

The driving wheel 3 can have the structure shown in FIG. 13. In the illustrated driving wheel 3, a first set of spokes 34C (also referred to first spokes 34C) and a second set of spokes 34D (also referred to second spokes 34D) are included as the spokes 34. The first spokes 34C are coupled to the first flange 37A of the hub portion 33. The second spokes 34D are coupled to the second flange 37B of the hub portion 33. The first spokes 34C and the second spokes 34D are alternately arranged. The first spokes 34C are shorter than the second spokes 34D. According to this arrangement, the center plane P as a vertical plane that passes through the center of the rim portion 32 in the width direction is deviated to the interior side from a vertical plane that passes through the center of the hub portion 33 in the width direction. In order to facilitate the understanding of the difference between the lengths of the first and second spokes 34C and 34D, the first and second spokes 34C and 34D are illustrated which extend from one point on the rim portion 32 to the flanges 37 in FIG. 13. It is noted that the first and second spokes 34C and 34D are not coupled to one point on the rim portion 32 in practice but are alternately arranged and spaced at a predetermined interval away from each other when coupled to the rim portion 32.

According to this driving wheel 3, since the rim portion 32 is offset inward relative to the center plane P of the hub portion 33, the hand rim 35, which is arranged on the exterior side of the rim portion 32, can be arranged on the interior side as compared with the case where the rim portion is not offset inward. As a result, the width of the entire wheelchair can be further reduced. In particular, when the wheelchair is folded in the width direction as shown in FIG. 5, the width of the folded wheelchair can be further reduced. Therefore, this wheelchair can be conveniently carried.

(Assistance Brake 65)

The wheelchair includes assistance brakes 65 which are used by the wheelchair assistant to brake the driving wheels 3. In the wheelchair shown in FIGS. 1 to 4, the brake mechanisms of the assistance brakes 65 are arranged inside the hub portions 33 of the driving wheels 3. The illustrated assistance brakes 65 are fastened to the exterior surfaces of the rectangular prism shaped axle portions 19, which are arranged in the lower end parts of the vertical frame portions 14. The brake mechanisms are held in the hub portions 33. According to the arrangement which holds the brake mechanisms of the assistance brakes 65 in the hub portions 33, the assistance brakes 65 can save space, and the width of the wheelchair can be small. The assistance brakes 65 are connected through the brake wire lines 67 to brake levers 66 which are arranged under grips 49 of the handle portions 9 of the wheelchair. The brake 65 functions by grasping the brake lever 66. The assistance brakes 65 can be operated by the assistant, or the like who stands behind the wheelchair and pushes the wheelchair.

(Parking Brake 60)

The wheelchair shown in FIGS. 1 and 2 includes parking brakes 60 which are arranged on the exterior surfaces of the both side frames 1 and can brake the driving wheels 3. The parking brakes 60 are positioned to be able to be operated by the user who sits on the seat 5. The illustrated parking brakes 60 are fastened to brake frames 17 which are coupled to in the both side frames 1, and are arranged on the front side relative to the driving wheels 3. The parking brake 17 includes a control lever 61 which can swing in the fore-and-aft direction, and a press portion 62 for braking which is pressed onto the surface of the driving wheel 3 by operating the control lever portion 61. This parking brake 60 can brake the rotation of the driving wheel 3 by pressing the press portion 62 onto the surface of the tire 31 of the driving wheel 3 when the user swing the control lever 61.

(Caster 4)

The casters 4 are small wheels which are free to swivel and fastened to the lower surface of the front end parts of the both side frames 1. More specifically, a pair of casters 4 are arranged on right and left sides of the illustrated wheelchair. When the user sits on the seat 5 and pushing forces applied to the hand rim 35 by hand, or when the assistant steers the wheelchair with the grip 49, the casters 4 allow the wheelchair to move in desired directions.

The wheelchair according to the present invention can be safely and conveniently used by users such as disabled persons and aged persons as a wheelchair which includes the driving wheels that are arranged on the both sides of the wheelchair body and can be rotated by hand to propel the wheelchair.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims.

What is claimed is:

1. A wheelchair comprising:

a wheelchair body that includes a seat; and driving wheels that are arranged on the both sides of the wheelchair body, and can be rotated by hand to propel the wheelchair, wherein each of said driving wheels includes:

a rim portion that holds a tire on an outer peripheral part of the rim portion;

a hub portion that is arranged at the center of said rim portion and coupled to said rim portion by connecting members, and can rotate with respect to said wheelchair body;

an annular hand rim that is arranged along said rim portion on an exterior side of said rim portion; and fastening members that fasten said hand rim to said rim portion, wherein said driving wheels can be rotated by pushing forces applied to said hand rims by hand, wherein said hand rim is arranged in proximity to said rim portion so that an insertion prohibition spacing is formed between said rim portion and said hand rim, wherein said insertion prohibition spacing is less than or equal to a distance of 15 mm, wherein said connecting members are spokes, and said spokes are spaced at a constant interval away from each other in the circumferential direction and couple said hub portion to an inner peripheral surface of said rim portion, wherein said fastening members are arranged at a midpoint between the spokes adjacent to each other on the inner peripheral surface of said rim portion, respectively, wherein said hub portion includes a pair of flanges that are arranged on the interior and exterior sides of said driving wheel, respectively, and said spokes are coupled to said flanges, wherein said spokes include first and second sets of spokes which are coupled to the first and second flanges, which are arranged on the interior and exterior sides of said driving wheel, respectively, and the first and second sets of spokes are alternately arranged, wherein said first set of spokes are shorter than said second set of spokes, and wherein said rim portion is offset inward relative to a center plane of said hub portion.

2. The wheelchair according to claim 1, wherein a gap in the width direction between said hand rim and said rim portion is less or equal to a distance of 15 mm.

3. The wheelchair according to claim 1, wherein the distance of said insertion prohibition spacing is dimensioned to be able to prohibit finger insertion into the insertion prohibition spacing.

4. The wheelchair according to claim 1, wherein the average diameter of said hand rim is smaller than an inner diameter of said rim portion.

5. The wheelchair according to claim 4, wherein said fastening member substantially extends in a horizontal direction, and has a first end which is fastened to an interior-side surface of said hand rim and a second end which is fastened to the inner peripheral surface of said rim portion.

6. The wheelchair according to claim 1, wherein the position of said hand rim can be adjusted in a width direction of the wheelchair by said fastening members.

7. The wheelchair according to claim 6, wherein each of said fastening members includes:

a fastening piece that protrudes from the inner peripheral surface toward the center of said rim portion;

a fastening screw that passes through said fastening piece and protrudes toward the exterior side of the driving wheel;

a cylindrical spacer that is arranged between said fastening piece and said hand rim, a shank part of said fastening screw being inserted into the cylindrical spacer; and a nut that is fastened to the interior side of said hand rim, and threadedly engages said fastening screw, wherein the position of said hand rim can be adjusted by adjusting a length of said cylindrical spacer.

8. The wheelchair according to claim 6, wherein each of said fastening members includes:

a fastening arm that has a first end which is fastened to said hand rim and a second end which is fastened to the inner peripheral surface of said rim portion; and a fastener that fastens said second end of said fastening arm to the inner peripheral surface of said rim portion, wherein said fastening arm has a plurality of through holes in said second end, and said fastening arm is fastened to said rim portion by said fastener which passes through one of said through holes, and the one of said through holes is selected to adjust the position of said hand rim.

9. The wheelchair according to claim 1, wherein said wheelchair body includes:

a pair of side frames that rotatably support said driving wheels coupled to the exterior sides of the side frames;

a folding linkage that includes seat frames, and has top and bottom ends which are coupled to said seat frames and said pair of side frames, respectively; and a flexible seat that is coupled to the right and left seat frames of said folding linkage, wherein said wheelchair body can be folded by moving said side frames toward each other in their vertical orientation, and wherein said flexible seat, which is coupled to said right and left seat frames, can be held under tension whereby forming said seat by moving said side frames away from each other when said wheelchair body is unfolded.

10. A wheelchair comprising:

a wheelchair body that includes a seat; and driving wheels that are arranged on the both sides of the wheelchair body, and can be rotated by hand to propel the wheelchair, wherein each of said driving wheels includes a rim portion that holds a tire on the outer peripheral part of the rim portion, a hub portion that is arranged at the center of said rim portion and coupled to said rim portion by connecting members, and can rotate with respect to said wheelchair body, an annular hand rim that is arranged along said rim portion on the exterior side of said rim portion, and fastening members that fasten said hand rim to said rim portion, wherein said driving wheels can be rotated by pushing forces applied to said hand rims by hand, wherein said hand rim is arranged in proximity to said rim portion so that an insertion prohibition spacing is formed between said rim portion and said hand rim, wherein said insertion prohibition spacing is less than or equal to a distance of 15 mm, wherein the position of said hand rim can be adjusted in the width direction of the wheelchair by said fastening members, wherein each of said fastening members includes a fastening arm that has a first end which is fastened to said hand rim and a second end which is fastened to the inner peripheral surface of said rim portion, and a fastener that fastens said second end of said fastening arm to the inner peripheral surface of said rim portion, and wherein said fastening arm has a plurality of through holes in said second end, and said fastening arm is fastened to said rim portion by said fastener which passes through one of said through holes, and the one of said through holes is selected to adjust the position of said hand rim.

* * * * *